US009718480B2

(12) United States Patent
Worden et al.

(10) Patent No.: US 9,718,480 B2
(45) Date of Patent: Aug. 1, 2017

(54) ADHESION CONTROL SYSTEM AND METHOD

(71) Applicant: General Electric Company, Schenectady, NY (US)

(72) Inventors: Bret Dwayne Worden, Erie, PA (US); Brian Douglas Lawry, Murrysville, PA (US); Jeremy Thomas McGarry, Erie, PA (US); Jennifer Lynn Coyne, Lawrence Park, PA (US); Matthew John Malone, Erie, PA (US)

(73) Assignee: General Electric Company, Schenectady, NY (US)

( * ) Notice: Subject to any disclaimer, the term of this patent is extended or adjusted under 35 U.S.C. 154(b) by 80 days.

(21) Appl. No.: 14/460,502

(22) Filed: Aug. 15, 2014

(65) Prior Publication Data

US 2015/0051759 A1 Feb. 19, 2015

Related U.S. Application Data

(60) Provisional application No. 61/866,248, filed on Aug. 15, 2013.

(51) Int. Cl.
*B61C 15/10* (2006.01)
*B61C 17/12* (2006.01)

(52) U.S. Cl.
CPC ..... *B61C 17/12* (2013.01); *B61C 15/107* (2013.01)

(58) Field of Classification Search
None
See application file for complete search history.

(56) References Cited

U.S. PATENT DOCUMENTS 77,602 A 5/1868 Floyd
440,690 A * 11/1890 Bevin ..... E01H 1/0836 15/340.1
490,269 A 1/1893 Chisholm
(Continued)

FOREIGN PATENT DOCUMENTS

BE 540032 A 8/1955
CN 2170241 Y 6/1994
(Continued)

OTHER PUBLICATIONS

Australian Office Action issued in connection with corresponding AU Application No. 2014213554 on Aug. 28, 2015.
(Continued)

*Primary Examiner* — Rami Khatib
(74) *Attorney, Agent, or Firm* — Global Patent Operation; John A. Kramer

(57) ABSTRACT

A system for controlling a consist of rail vehicles or other vehicles includes a control unit electrically coupled to a first rail vehicle in the consist, the control unit having a processor and being configured to receive signals representing a presence and position of one or more tractive effort systems on-board the first vehicle and other rail vehicles in the consist, and a set of instructions stored in a non-transient medium accessible by the processor, the instructions configured to control the processor to create a optimization schedule that manages the use of the one or more tractive effort systems based on the presence and position of the tractive effort systems within the consist.

11 Claims, 21 Drawing Sheets

(56) References Cited

U.S. PATENT DOCUMENTS

| | | | | |
|---|---|---|---|---|
| 893,878 | A | 7/1908 | Shires | |
| 1,486,578 | A | 3/1924 | Harney | |
| 1,951,553 | A | 3/1934 | Martin | |
| 1,993,145 | A | 3/1935 | Kirk | |
| 2,597,719 | A | 5/1952 | Foster | |
| 2,606,781 | A | 8/1952 | Loftus | |
| 2,654,622 | A | 10/1953 | Foster | |
| 3,020,071 | A | 2/1962 | Makinson | |
| 3,345,097 | A | 10/1967 | Smith | |
| 3,345,098 | A | 10/1967 | Kilgore et al. | |
| 4,044,921 | A * | 8/1977 | Caverly | B65D 88/68 141/391 |
| 4,108,077 | A | 8/1978 | Laing | |
| 4,230,045 | A | 10/1980 | Fearon | |
| 4,434,719 | A | 3/1984 | Mekosh, Jr. | |
| 4,747,627 | A | 5/1988 | Shigeura et al. | |
| 4,781,121 | A | 11/1988 | Kumar et al. | |
| 5,119,991 | A | 6/1992 | Divers | |
| 5,251,724 | A | 10/1993 | Szatkowski et al. | |
| 5,580,106 | A | 12/1996 | Dulberg et al. | |
| 5,919,295 | A | 7/1999 | Lamba et al. | |
| 6,148,732 | A * | 11/2000 | Conway | E01H 8/105 104/279 |
| 6,276,281 | B1 | 8/2001 | Mesalic et al. | |
| 6,629,709 | B1 | 10/2003 | Tunley et al. | |
| 6,797,918 | B1 | 9/2004 | Higgins | |
| 6,893,058 | B2 | 5/2005 | Kumar et al. | |
| 6,976,713 | B2 | 12/2005 | Kish et al. | |
| 7,152,888 | B2 | 12/2006 | Kumar et al. | |
| 7,290,807 | B2 | 11/2007 | Kumar | |
| 7,529,614 | B1 * | 5/2009 | Muller | F02B 37/16 123/559.1 |
| 7,594,682 | B2 | 9/2009 | Kumar et al. | |
| 8,073,591 | B2 | 12/2011 | Bartling | |
| 8,500,177 | B2 | 8/2013 | Bartling | |
| 2003/0197386 | A1 | 10/2003 | Dalrymple | |
| 2004/0070265 | A1 | 4/2004 | Sakai et al. | |
| 2004/0262425 | A1 | 12/2004 | Sakai et al. | |
| 2006/0005739 | A1 | 1/2006 | Kumar | |
| 2008/0252082 | A1 | 10/2008 | Bartling | |
| 2009/0032350 | A1 | 2/2009 | Shapery | |
| 2010/0070117 | A1 | 3/2010 | Siffert | |
| 2011/0050796 | A1 * | 3/2011 | Nishida | B41J 2/16526 347/29 |
| 2011/0099413 | A1 | 4/2011 | Cooper et al. | |
| 2011/0308765 | A1 | 12/2011 | Kumar et al. | |
| 2012/0158223 | A1 | 6/2012 | Liberatore et al. | |
| 2013/0173094 | A1 | 7/2013 | Cooper et al. | |
| 2013/0206862 | A1 * | 8/2013 | Worden | B61C 15/107 239/99 |
| 2014/0032083 | A1 | 1/2014 | Kerns et al. | |
| 2014/0033752 | A1 | 2/2014 | Gunjima et al. | |
| 2014/0151460 | A1 * | 6/2014 | Noffsinger | B61C 15/10 239/69 |
| 2015/0053109 | A1 | 2/2015 | Bramlett | |

FOREIGN PATENT DOCUMENTS

| | | | | |
|---|---|---|---|---|
| CN | 101119880 | A | 2/2008 | |
| CN | 201283865 | Y | 8/2009 | |
| DE | 1195793 | B | 7/1965 | |
| DE | 19640559 | A1 | 4/1998 | |
| DE | 102005001404 | A1 | 7/2006 | |
| DE | 102007044367 | A1 | 3/2009 | |
| EP | 0499199 | A2 | 8/1992 | |
| WO | 2006000093 | A1 | 1/2006 | |
| WO | 2006062056 | A1 | 6/2006 | |
| WO | 2006088880 | A1 | 8/2006 | |
| WO | 2012021225 | A2 | 2/2012 | |
| WO | WO 2012021225 | A2 * | 2/2012 | B61C 15/107 |

OTHER PUBLICATIONS

PCT Search Report and Written Opinion issued in connection with Related PCT Application No. PCT/US2011/042943 on Mar. 6, 2012.

Australian Office Action issued in connection with Related AU Application No. 2011289809 on Jun. 24, 2014.

Chinese Office Action issued in connection with Related CN Application No. 201180039129.8 on Sep. 3, 2014.

Eurasian Office Action issued in connection with Related EA Application No. 201390047 on Oct. 31, 2014.

US Non-Final Office Action issued in connection with Related U.S. Appl. No. 13/816,036 on Jan. 29, 2015.

Unofficial English Translation of Chinese Office Action issued in connection with Related CN Application No. 201180039129.8 on Apr. 27, 2015.

Australian Notice of Allowance issued in connection with Related AU Application No. 2011289809 on Oct. 19, 2015.

US Final Office Action issued in connection with Related U.S. Appl. No. 13/816,036 on Sep. 18, 2015.

Eurasian Office Action issued in connection with Related EA Application No. 201390047 on Dec. 15, 2015.

US Non-Final Office Action issued in connection with Related U.S. Appl. No. 14/461,092 on Jan. 14, 2016.

PCT Search Report and Written Opinion issued in connection with Corresponding PCT Application No. PCT/US2016/058483 on Feb. 1, 2017.

* cited by examiner

ADHESION CONTROL SYSTEM AND METHOD

CROSS-REFERENCE TO RELATED APPLICATION

This application claims priority to U.S. Provisional Application No. 61/866,248, filed Aug. 15, 2013, which is hereby incorporated by reference.

FIELD OF THE INVENTION

Embodiments of the invention relate generally to vehicle control. Other embodiments relate to systems and methods for controlling vehicles in a vehicle consist.

BACKGROUND OF THE INVENTION

A vehicle "consist" is group of two or more vehicles mechanically and/or logically coupled or linked together to travel along a route. For example, a rail vehicle consist is a group of two or more rail vehicles that are mechanically coupled or linked together to travel along a route, as defined by a set of rails that support and guide the rail vehicle consist. One type of rail vehicle consist is a train, which may include one or more locomotives (or other powered rail cars/vehicles) and one or more non-powered rail cars/vehicles. (In the context of a rail vehicle consist, "powered" means capable of self propulsion and "non-powered" means incapable of self propulsion.) Each locomotive includes traction equipment for moving the train, whereas each rail car is configured for hauling passengers or freight. A consist may also include a group of two or more vehicles that are logically but not mechanically connected to travel along a route, e.g., coordinated control of non-mechanically linked vehicles, using wireless communications.

The rail vehicles in the consist, most typically the locomotives, may be outfitted with various functional components and systems, such as throttling, steering, braking and tractive effort/adhesion control systems. Typically, each locomotive in the consist is outfitted with an air compressor that produces a supply of pressurized air for use by one or more of these systems. The compressed air is typically stored in a main reservoir on-board each locomotive and the main reservoirs are fluidly coupled to one another through a main reservoir equalizing pneumatic trainline running throughout the length of the consist.

When compressed air is needed to perform a function such as braking or to increase tractive effort, the air may be drawn from the respective main reservoir by the system performing the desired function. For example, existing tractive effort/adhesion control systems direct a flow of compressed air from the main reservoir to a nozzle pointed at the contact surface of the rail to clean the rail of snow, ice or debris to increase adhesion/tractive effort. It has been shown that higher air flow to the nozzle of a tractive effort system translates into more rail vehicle tractive effort. Notably, however, existing tractive effort systems may consume air at a higher rate than the typical rail vehicle air compressor capability but generally within the capability of a multi-locomotive power consist.

Accordingly, there is a need for an adhesion control system and method for use with a rail vehicle that optimizes air use and compression.

BRIEF DESCRIPTION OF THE INVENTION

An embodiment of the present invention relates to a control system, e.g., a system for controlling a consist of rail vehicles or other vehicles. The system includes a control unit electrically coupled to a first rail vehicle in the consist, the control unit having a processor and being configured to receive signals representing a respective presence and position of one or more tractive effort systems on-board the first vehicle and other rail vehicles in the consist, and a set of instructions stored in a non-transient medium accessible by the processor, the instructions configured to control the processor to create a schedule (e.g., an optimization schedule) that manages the use of the one or more tractive effort systems based on the presence and position of the tractive effort systems within the consist.

Another embodiment relates to a method for controlling (e.g., optimizing) a consist of at least first and second rail vehicles or other vehicles. The method includes the steps of determining a configuration of tractive effort systems within the consist and enabling the tractive effort systems in dependence upon the determined configuration to increase tractive effort.

Another embodiment relates to a method of controlling (e.g., optimizing) a flow of air to a tractive effort system of a rail vehicle or other vehicle. The method includes the steps of providing a supply of pressurized air from a reservoir to the tractive effort system, and varying the flow of air to the tractive effort system to maintain a pressure in the reservoir above a predetermined lower threshold.

Another embodiment relates to a system for control of a rail vehicle or other vehicle. The system includes a tractive effort device having a nozzle positioned to direct a flow of air to a rail, a reservoir fluidly coupled to the tractive effort device for providing a supply of compressed air to the tractive effort device, and a control unit electrically coupled to the tractive effort device and configured to control a flow of compressed air from the reservoir to the tractive effort device in dependence upon an available pressure within the reservoir.

Yet another embodiment relates to a system for use with a vehicle having a wheel that travels on a surface, e.g., a rail vehicle having a wheel that travels on a rail. The system includes a tractive effort system including an air source for supplying compressed air and a nozzle fluidly coupled to the air source and configured to direct a flow of compressed air from the air source to a contact surface of the rail, and a control unit electrically coupled to the tractive effort system and configured to control the tractive effort system between an enabled state, in which compressed air flows from the air source and out of the nozzle of the tractive effort system, and a disabled state, in which compressed air is prevented from exiting the nozzle. The control unit is further configured to control the tractive effort system from the enabled state to the disabled state in dependence upon the presence of at least one adverse condition.

Yet another embodiment relates to a method for controlling a rail vehicle or other vehicle. The method includes providing a tractive effort system having a nozzle for directing the flow of compressed air to the contact surface of a rail and disabling the tractive effort system when an adverse condition is detected.

Another embodiment relates to a system for use with a vehicle having a wheel that travels on a surface, e.g., a rail vehicle having a wheel that travels on a rail. The system includes an air source for supplying compressed air, a nozzle fluidly coupled to the air source and configured to direct a flow of compressed air from the air source to a contact surface of the rail, a valve positioned intermediate the air source and the nozzle, the valve being controllable between a first state in which the compressed air flows from the air source to the nozzle, and a second, disabled state in which the compressed air is prevented from flowing to the nozzle, a controller for controlling the valve between the first state and the second, disabled state, and an operator interface electrically coupled to the controller, the operator interface including a momentary disable switch biased to a position that controls the valve to the first state and movable against the bias to control the valve to the second, disabled state.

Another embodiment relates to a system for controlling a consist of vehicles having a plurality of wheels that travel on a surface, e.g., a consist of rail vehicles having a plurality of wheels that travel on a rail. The system includes a tractive effort system on-board a first rail vehicle. The tractive effort system includes a media reservoir capable of holding a tractive material, a tractive material nozzle in communication with the media reservoir and configured to direct a flow of tractive material to a contact surface of the rail, a compressed air reservoir, and a compressed air nozzle in communication with the compressed air reservoir and configured to direct a flow of compressed air to the contact surface of the rail. The system further includes a control unit electrically coupled to a first rail vehicle in the consist, the control unit having a processor and being configured to receive signals indicative of slippage, individual axle tractive effort, overall rail vehicle tractive effort and horsepower. The control unit is further configured to control the tractive effort system to apply compressed air only to the contact surface of the rail and monitor at least one of slippage, individual axle tractive effort, overall rail vehicle tractive effort and horsepower after application of the compressed air only.

Yet another embodiment relates to a method for controlling a rail vehicle or other vehicle having a tractive effort system. The method includes the steps of enabling the tractive effort system to apply a blast of air only to the rail, monitoring one of slip, individual axle tractive effort, overall tractive effort and horsepower, and enabling the tractive effort system to apply tractive material to the rail in dependence upon at least one parameter.

BRIEF DESCRIPTION OF THE DRAWINGS

The present invention will be better understood from reading the following description of non-limiting embodiments, with reference to the attached drawings, wherein below.

DETAILED DESCRIPTION OF THE INVENTION

Figure 1:
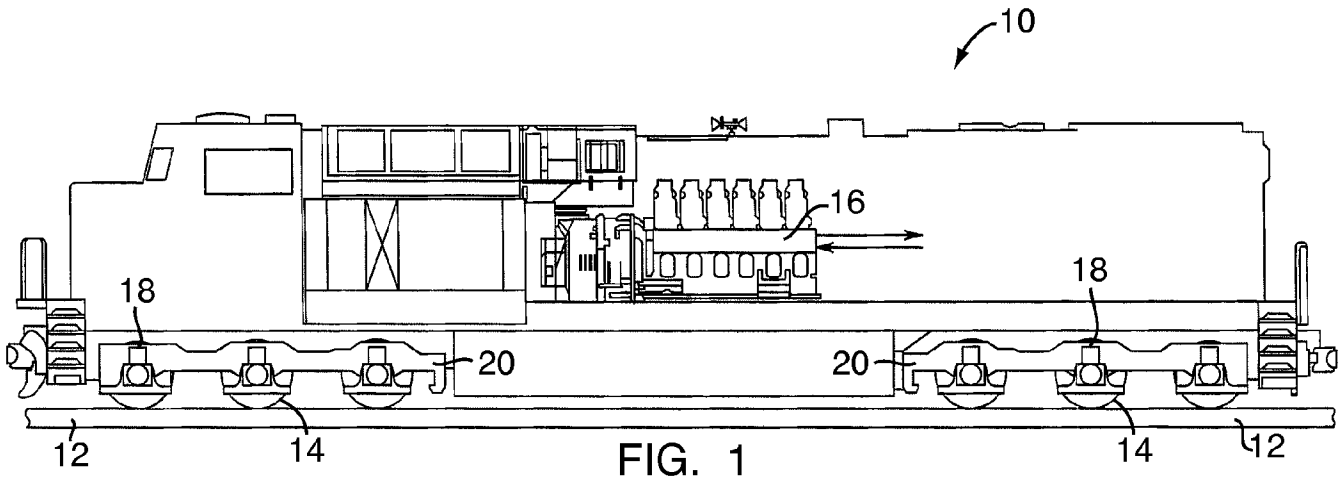
FIG. 1 is a schematic drawing of an exemplary rail vehicle.

Reference will be made below in detail to exemplary embodiments of the invention, examples of which are illustrated in the accompanying drawings. Wherever possible, the same reference numerals used throughout the drawings refer to the same or like parts. Although exemplary embodiments of the present invention are described with respect to locomotives, embodiments of the invention are also applicable for use with rail vehicles generally, meaning any vehicle that travels on a rail or track.

Embodiments of the invention relate to systems and methods for controlling a vehicle and, more particularly to adhesion control systems and methods for use with a rail vehicle.

Figure 2:
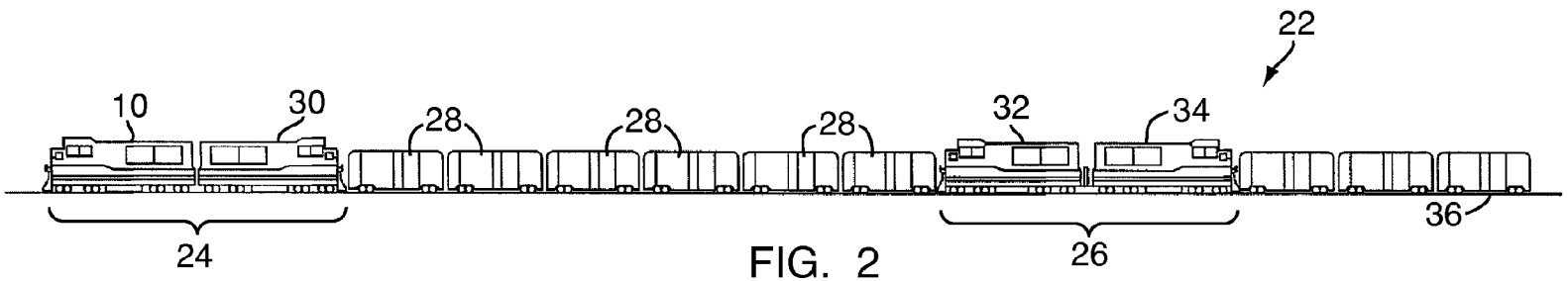
FIG. 2 is a schematic drawing of a rail vehicle consist, according to an embodiment of the present invention.

FIG. 1 is a schematic diagram of a rail vehicle 10, herein depicted as a locomotive, configured to run on a rail 12 via a plurality of wheels 14. As shown therein, the rail vehicle 10 includes an engine 16, such as an internal combustion engine. A plurality of traction motors 18 are mounted on a truck frame 20, and are each connected to one or more of the plurality of wheels 14 to provide tractive power to selectively propel and retard the motion of the rail vehicle 10. The rail vehicle 10 may be a part of a As shown in FIG. 2, the rail vehicle 10 may be a part of rail vehicle consist 22. The consist may include a lead locomotive consist 24, a remote or trail locomotive consist 26, and plural non-powered rail vehicles (e.g., freight cars) 28 positioned between the two consists 24, 26. The lead locomotive consist 24 may include a lead locomotive, such as rail vehicle 10, and trail locomotive 30. The remote locomotive consist 26 also may include a lead locomotive 32 and a trail locomotive 34. All of the rail vehicles in the consist are sequentially mechanically connected together for traveling along a rail track or other guideway 36.

Figure 3:
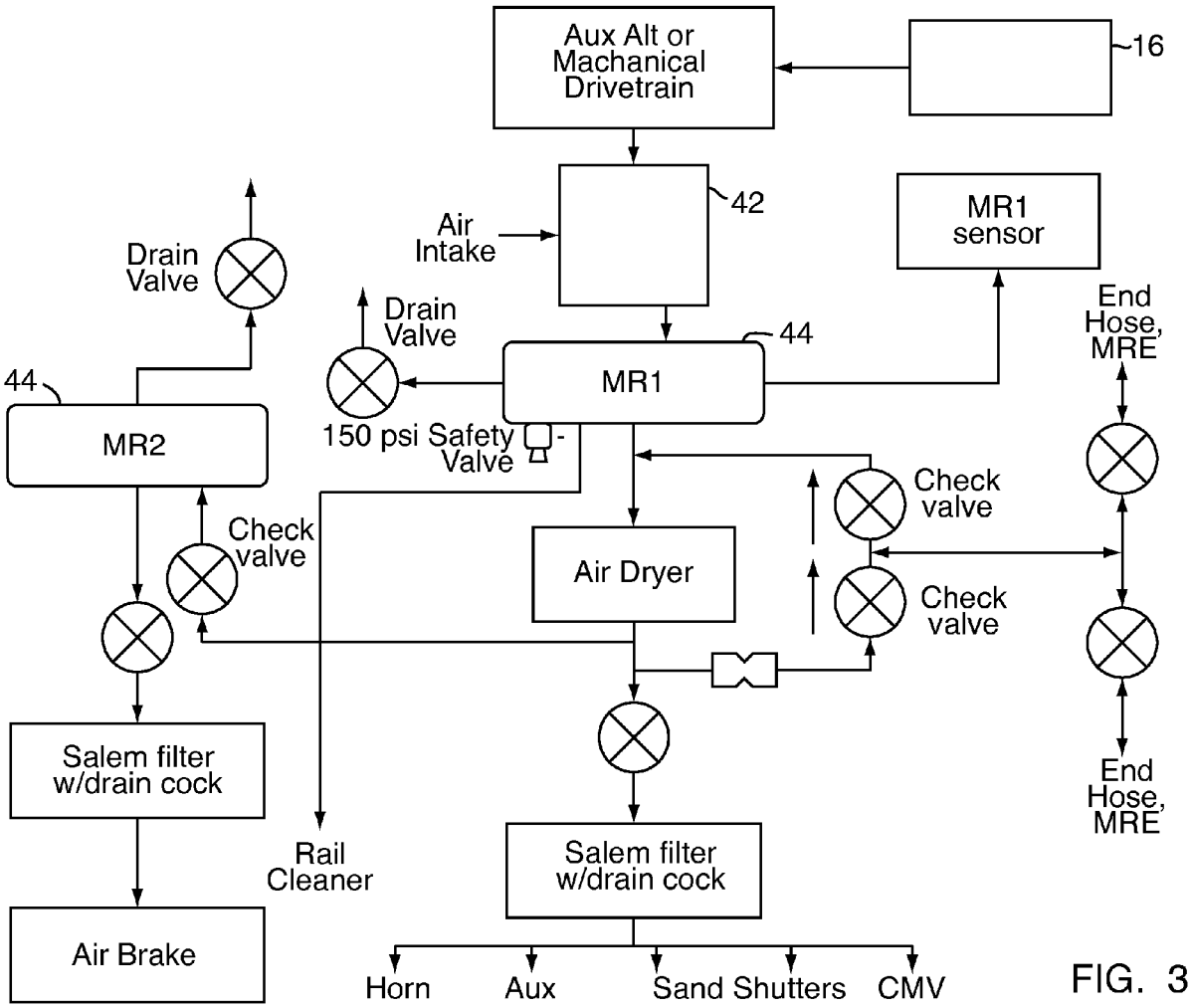
FIG. 3 is a flow diagram of a compressed air system of a rail vehicle, according to an embodiment of the present invention.

As alluded to above, one or more of the locomotives 10, 20, 32, 34 in the consist 22 may have an on-board compressed air system for supplying one or more functional systems of the consist 22 with compressed air. In an embodiment, each of the locomotives in the consist may be outfitted with a compressed air system. In other embodiments, fewer than all but at least one of the locomotives in the consist may be outfitted with a compressed air system. A flow diagram illustrating an exemplary compressed air system 40 is shown in FIG. 3. As shown therein, the compressed air system 40 includes an air compressor 42 driven by the engine 16. As is known in the art, the air compressor 42 intakes air, compresses it and stores it in one or more main reservoirs 44 on-board the locomotive. The compressed air from the main reservoirs 44 may then be utilized by various systems within the consist 22, such as an air braking system, horn, sanding system, and adhesion control/tractive effort system. As discussed below, the main reservoir on-board each locomotive is fluidly coupled to the main reservoir on-board the other locomotives in the consist through a main reservoir equalizing (MRE) pneumatic trainline. As used herein, "fluidly coupled" or "fluid communication" refers to an arrangement of two or more features such that the features are connected in such a way as to permit the flow of fluid between the features and permits fluid transfer.

Figure 4:
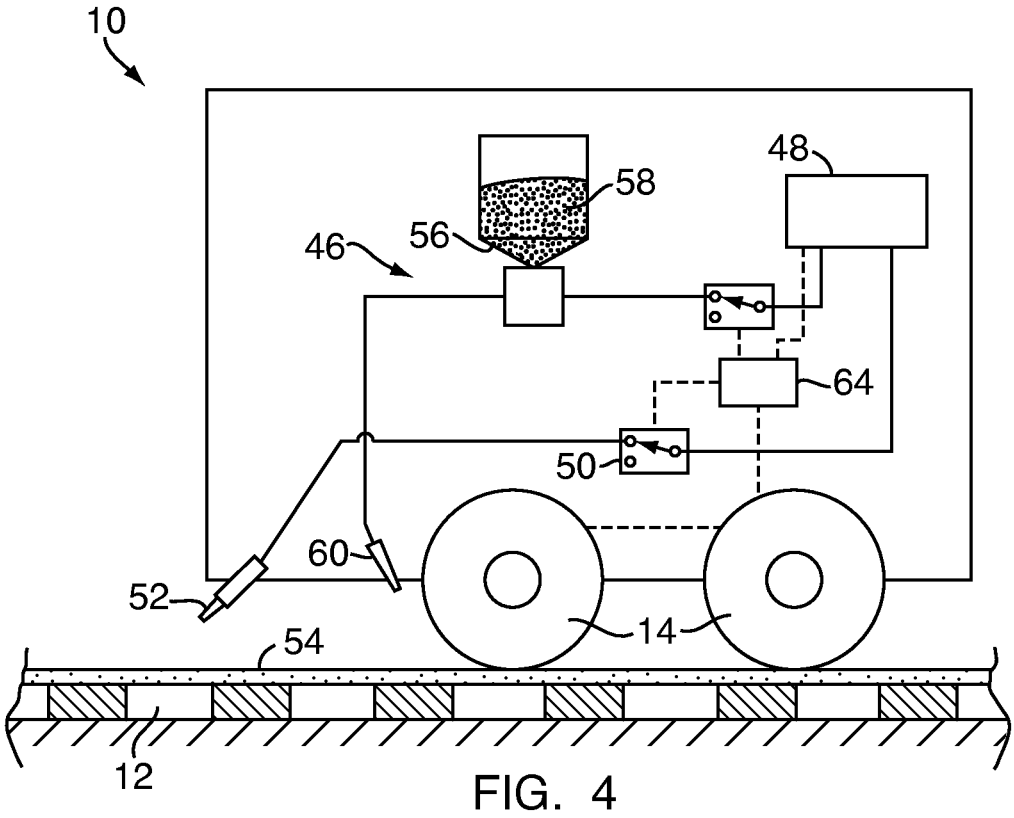
FIG. 4 is a schematic drawing of a tractive effort system on a rail vehicle, according to an embodiment of the present invention.

In an embodiment, the adhesion control/tractive effort system may be any high velocity, high flow tractive effort control system known in the art, such as those disclosed in PCT Application No. PCT/US2011/042943, which is hereby incorporated by reference herein in its entirety. For example, as shown in FIG. 4, a tractive effort system 46 includes a supply of pressurized air 48. The supply of pressurized air may be a main reservoir on board the locomotive or the MRE pneumatic trainline (wherein the pressurized air may be supplied by one or more air compressors within the locomotive consist). The supply of pressurized air 48 is fluidly coupled, through a pressurized air control valve 50, to a nozzle 52 oriented to direct a high velocity, high flow of air jet to a contact surface 54 of the rail 12. The tractive effort system 46 may also include a reservoir 56 for holding a supply of tractive material 58, such as sand, and a nozzle 60 fluidly coupled to the reservoir 56 via a tractive material control valve 60 and oriented to direct a flow of tractive material 58 to the contract surface 54 of the rail 12.

In an embodiment, the air nozzle 52 is positioned to direct a high flow, high velocity air jet to the rail 12 in front of the lead axle of a lead locomotive in a locomotive consist. In other embodiments, both lead and trail locomotives may have tractive effort systems 46. In addition, tractive material nozzle 60 is positioned to direct a flow of tractive material to the rail 12 in front of and behind both the lead and trail axles of a locomotive.

Figure 5:
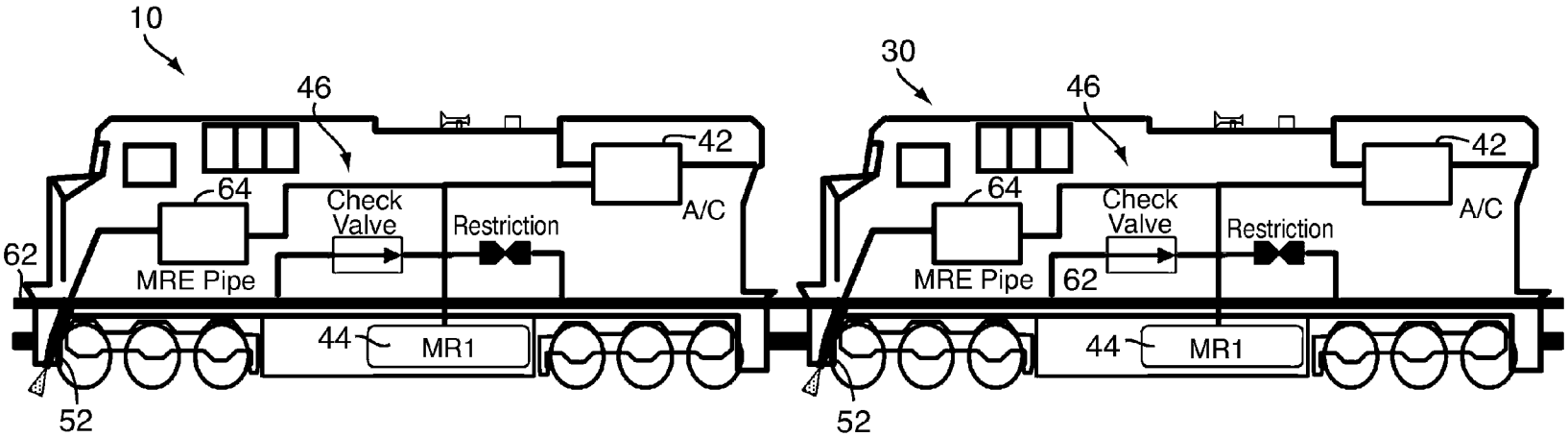
FIG. 5 is a schematic drawing of a tractive effort system equipped rail vehicle consist, according to an embodiment of the present invention.

FIG. 5 shows two locomotives 10, 30 coupled together in a consist. Each locomotive 10, 30 has a tractive effort system 46 thereon. As shown therein, an air compressor 42 on board each locomotive 10, 30 is configured to supply compressed air to a main reservoir 44. The main reservoirs 44 of each locomotive are fluidly coupled to one another via the MRE pneumatic trainline 62. In this manner, each locomotive with an air compressor 42 and main reservoir 44 feeds the MRE trainline 62 through a restrictive path. This restriction may be a specific orifice or the restriction associated with an air dryer. The main reservoirs 44 of each locomotive are also fluidly coupled to the air nozzle 52 of the tractive effort system 46 for supplying the nozzles 52 with pressurized air. Moreover, as shown therein, each tractive effort system 46 is electrically coupled to a control unit 64 on board the locomotives 10, 30 for controlling the tractive effort systems 46 in accordance with embodiments of the present invention, as discussed below.

While FIG. 5 illustrates a two locomotive consist with tractive effort systems 46 on each locomotive, there may be any combination of both tractive effort quipped and non tractive effort equipped locomotives in a conventional or distributed power consist. Moreover, the locomotives in the consist may include locomotive to locomotive communication in the form of a standard wired trainline, a high bandwidth communications link such as trainline modem or Ethernet trainline, or distributed power (remote or radio controlled). In some embodiments, there may be no communication between locomotives.

In an embodiment, a system and method for tractive effort consist optimization is provided. As will be readily appreciated, for any locomotive consist, such as that shown in FIG. 5, there will typically be at least one air compressor available to contribute to the total compressed air need of the consist. In an embodiment, a method for tractive effort consist optimization includes maximizing the air to the lead-most tractive effort system position. If locomotive to locomotive communication is present, then the detailed configuration of the tractive effort system configuration within the consist may be easily determined/sensed using known methods and shared among the locomotives.

Figure 6:
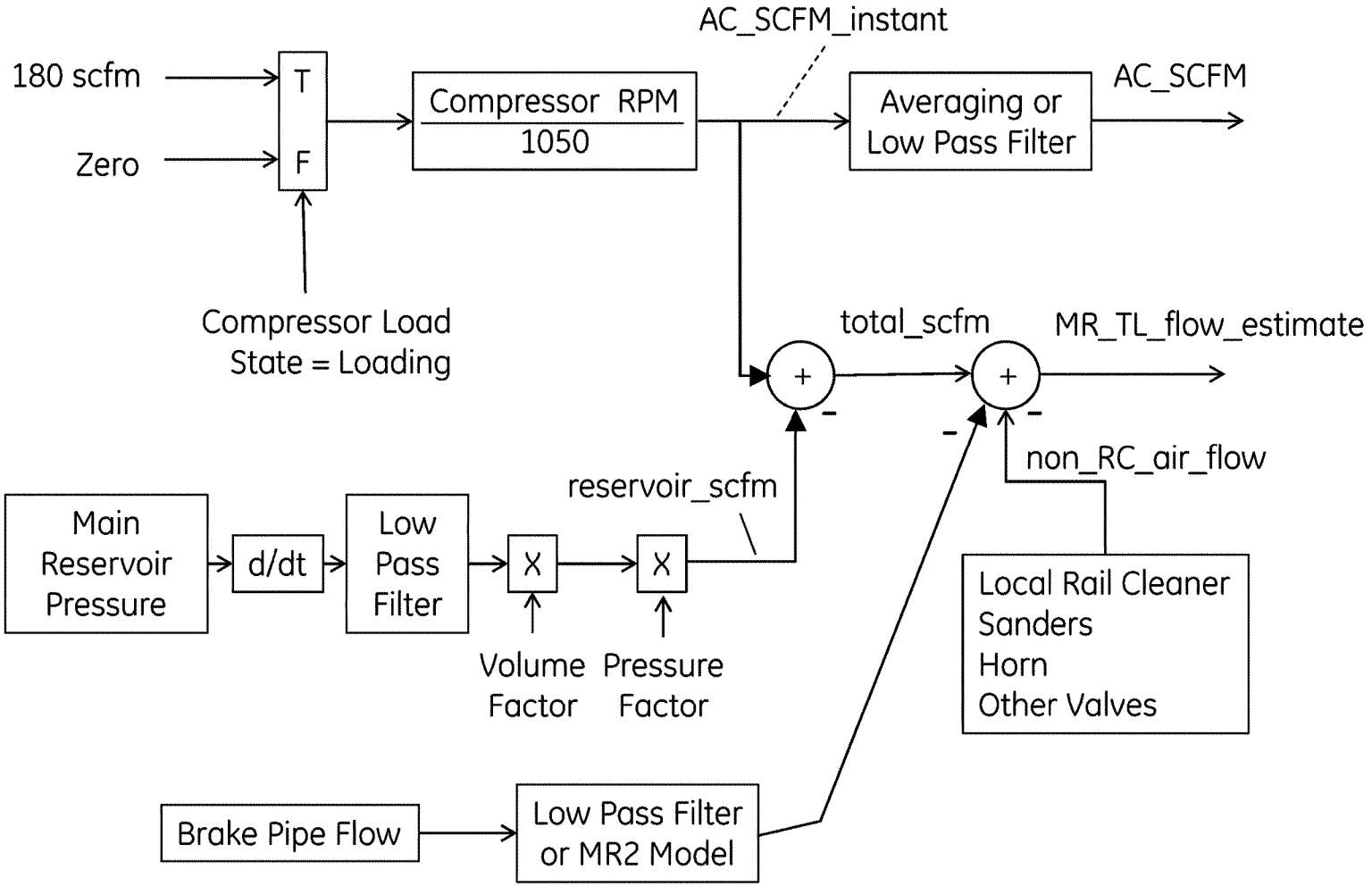
FIG. 6 is a flow diagram illustrating a method for estimating the air flow delivered to an MRE trainline, according to an embodiment of the present invention.

More typically, however, each locomotive may only know the lead/trail status of itself, the air flow to the brake pipe if the locomotive is a lead locomotive, and the direction of the locomotive (short hood/long hood). In this situation, at least one of the locomotives within the consist must be able to determine if there is a tractive effort system in the consist. In connection with this, FIG. 6 is a flow diagram illustrating a method to estimate the air flow delivered to the MRE pneumatic trainline 62. As shown therein, in an embodiment, a control unit on-board one of the locomotives may utilize integrated control information regarding air compressor speed and load state, reservoir air pressure derivatives and the states of other pneumatic actuators or loads within the vehicle to develop an approximate value of air flow to the MRE pipe 62. From this value, the control unit is able to determine whether or not a particular locomotive is configured with a tractive effort system.

In an embodiment, for a lead locomotive having a tractive effort system without variable flow, determining tractive effort system configuration is not needed. In this situation, the tractive effort system 46 of the lead locomotive is enabled by the control unit 64, e.g., by actuating the air control valve 50, until the pressure in the main reservoir 44 is less than approximately less than 110 psi (758 kPa). For a lead locomotive having a tractive effort system with variable flow, however, the control unit 64 is configured to automatically adjust the flow through the air control valve 50 to the maximum level that maintains a pressure in the main reservoir 44 above approximately 110 psi. In both of these instances, the air compressor 42 is controlled by the control unit 64 to maximum flow if the main reservoir pressure is less than approximately 135 psi (930 kPa) and is shut off at approximately 145 psi (1000 kPa).

In an embodiment, for a lead locomotive without a tractive effort system and having a communication link to a trail locomotive, the configuration of the tractive effort system(s) within the consist is first determined via the communication link. As discussed above, if there is no communication link to a trail locomotive, a tractive effort system elsewhere in the consist may be determined by estimating the air flow delivered to the MRE pipe 62. In both of these situations, if a trail locomotive has a tractive effort system, the air compressor is loaded to maximum flow if the main reservoir pressure is less than approximately 135 psi and is shut off at approximately 145 psi.

In another embodiment, for a trail locomotive having an on-board tractive effort system and having a communication link to a lead locomotive, the configuration of the tractive effort system(s) within the consist is first determined via the communication link. If a more leading locomotive has a tractive effort system, the tractive effort system of the trail locomotive is enabled so long as the pressure within the main reservoir 44 of the trail locomotive is above approximately 141 psi. As will be readily appreciated, this maximizes the air to the more leading locomotive. As used herein, "more leading" refers to a position of a locomotive within a consist physically ahead of another locomotive within the same consist. If there is not a more leading locomotive having a tractive effort system within the consist, the tractive effort system of the trail locomotive is enabled as long as the pressure within the main reservoir 44 is above approximately 110 psi. If it determined that the trail locomotive is a final trail locomotive within the consist, and in a long hood direction, the tractive effort system 46 is disabled by the control unit 64. In any of these situations, the air compressor is loaded to maximum flow if the main reservoir pressure is less than approximately 138 psi and is shut off at approximately 145 psi.

For a tail locomotive having a tractive effort system wherein there is no communication to a lead locomotive in the consist, the configuration of tractive effort systems in the consist may again be determined by estimating the air flow delivered to the MRE pipe 62. If another tractive effort system is detected/determined within the consist, the tractive effort system of the trail locomotive is enabled so long as the pressure within the main reservoir 44 of the trail locomotive is above approximately 141 psi. In this situation, the air compressor is loaded to maximum flow if the main reservoir pressure is less than approximately 138 psi and is shut off at approximately 145 psi.

Lastly, for a trail locomotive without a tractive effort system, the configuration of tractive effort systems elsewhere in the consist is determined through the communications link to the lead locomotive, if present, or by estimating the MRE pipe air flow, as discussed above. If it is determined that another locomotive has a tractive effort system, then the air compressor is loaded to maximum air flow if the main reservoir pressure is less than approximately 135 psi and is shut off at approximately 145 psi.

As discussed above, a tractive effort system provides an increase in tractive effort by applying a high velocity, high flow air jet to the contact surface of a rail. As also disclosed above, various control logic is utilized to optimize the use of the tractive effort systems within a consist in dependence upon the position of the tractive effort systems within the consist, the capability of the air compressors within the consist and the compressed air demands of other systems in the consist. In order to sustain the high flow level required for the tractive effort systems to provide peak tractive effort performance improvements, flow to or through the tractive effort systems must be maximized while maintaining main reservoir pressure above a certain lower threshold. Accordingly, an embodiment of the present invention is directed to a system and method for optimizing the flow of compressed air to a tractive effort system and, more particularly, to a system and method for varying the flow to a tractive effort system (or to the air nozzle 52 thereof) in order to maintain a required lower threshold pressure within the main reservoir 44.

Figure 7:
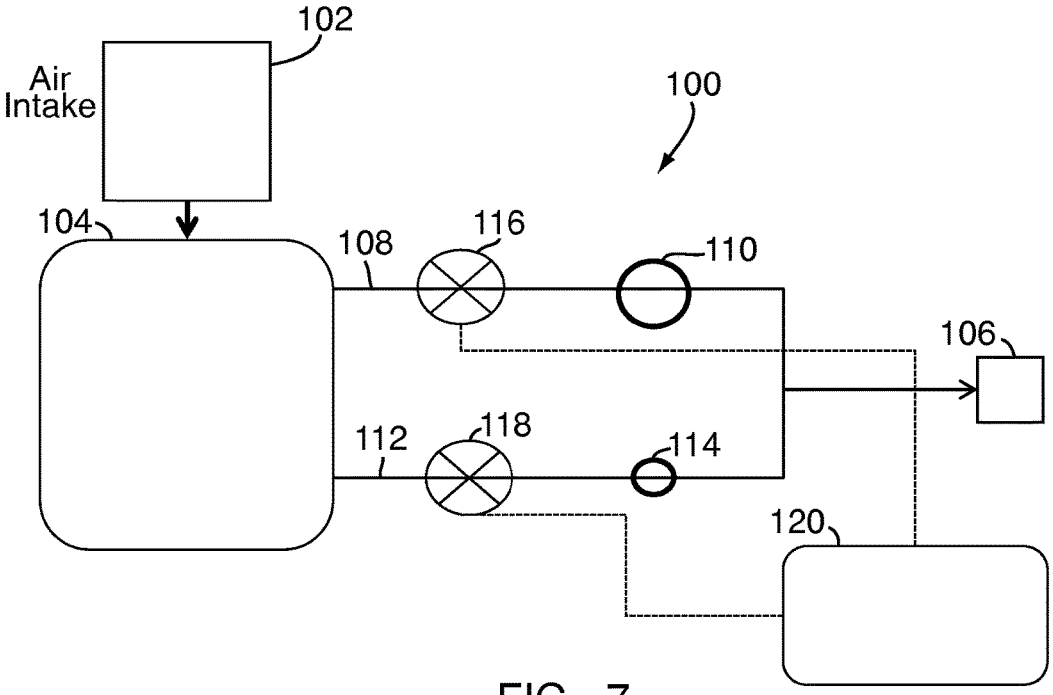
FIG. 7 is schematic drawing of a variable flow tractive effort system, according to an embodiment of the present invention.

With reference to FIG. 7, a variable flow system 100 in accordance with an embodiment of the present invention is shown. As shown therein, an air compressor 102 compresses air, which is stored in a main reservoir 104 on board a rail vehicle or locomotive. The main reservoir 104 is fluid communication with a tractive effort system 106, such as that described above, through a first pathway 108 having a large orifice 110 therein and a second pathway 112 having a small orifice 114 therein. A first valve, such as solenoid valve 116 selectively controls the flow of compressed air through the first pathway 108 and the large orifice 110 to the tractive effort system 106 and a second valve, such as second solenoid valve 118, selectively controls the flow of compressed air through the second pathway 110 and the small orifice 114 to the tractive effort system 108. A control unit is electrically coupled to the first and second valves 116, 118 and is configured to selectively control the first and second valves 116, 118 between a first state, in which compressed air flows through the valves 116, 118, through the orifices 110, 114 and to the tractive effort system 106, and a second state in which compressed air is prevented from flowing through the valves 116, 118.

In operation, the control unit detects the pressure within the main reservoir 104 and controls the flow of compressed air from the main reservoir through either or both of the large orifice 110 and small orifice 114 in dependence upon the detected pressure. Generally, if tractive effort is needed and the pressure within the main reservoir is close to a predetermined lower threshold pressure, the control unit 120 may control the second solenoid valve 118 to its second state and the first solenoid valve 116 to its first state such that a flow of compressed air through the small orifice 114 only is permitted. As will be readily appreciated, a lower pressure in the main reservoir 104 may be a result of other systems utilizing the available supply of compressed air, air compressors operating at less than maximum capacity, etc. If however, the pressure within the main reservoir 104 is sufficiently high, the control unit 120 may control both the first and second valves 116, 118 to their respective first states such that compressed air is permitted to flow through both the large and small orifices 110, 114. As will be readily appreciated, by controlling both valves to their respective first positions, maximum flow to the tractive effort system, and thus maximum tractive effort improvement, is achieved.

In an embodiment, with both the first and second valves 116, 118 in their respective first (enabled) states, thus enabling flow through both the large orifice 110 and small orifice 114, a flow of approximately 300 cubic feet per minute (cfm) to the nozzle(s) of the tractive effort system 106 may be realized. In an embodiment, with only the first valve 116 in its first (enabled) state, and thus flow through the large orifice 110 only, a flow of approximately 225 cfm may be realized. Similarly, with only the second valve 118 in its first (enabled) state, and thus flow through the small orifice 114 only, a flow of approximately 150 cfm may be realized. Given these expected flow rates when flow is enabled through either the large, small or both orifices 110, 114, a control strategy that maximizes the flow to the tractive effort system in dependence upon the available pressure within the main reservoir may be generated. As will be readily appreciated, the flow to a tractive effort system may be maximized by cycling between the options described above (e.g., first valve enabled, second valve disabled; second valve enabled, first valve disabled; both valves enabled; both valves disabled), in dependence upon the pressured detected within the main reservoir at any given time.

Figure 8:
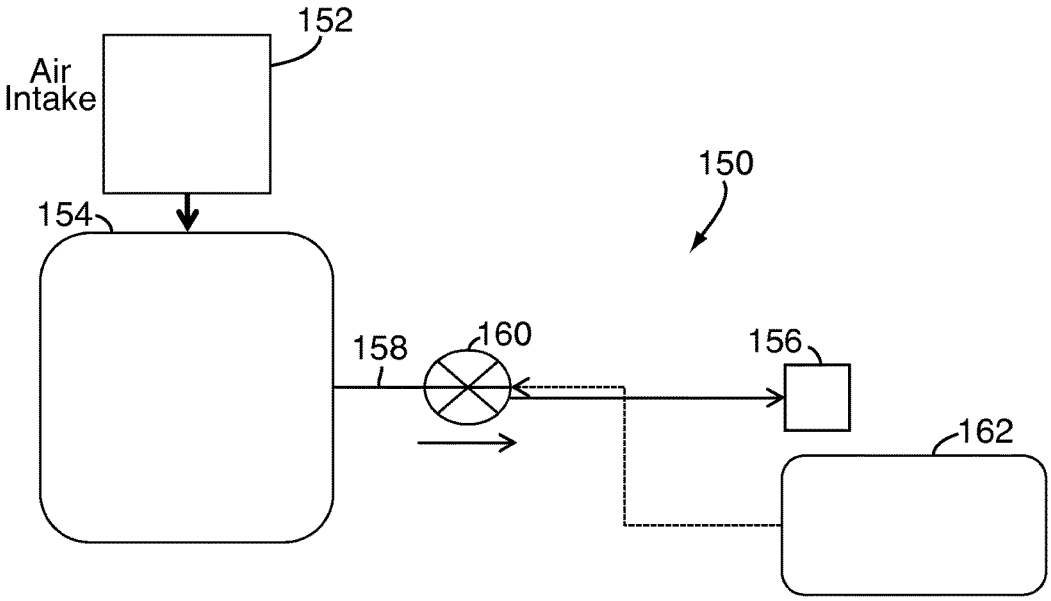
FIG. 8 is a schematic diagram of a variable flow tractive effort system, according to another embodiment of the present invention.

With reference to FIG. 8, a variable flow system 150 in accordance with another embodiment of the present invention is shown. As shown therein, an air compressor 152 compresses air, which is stored in a main reservoir 154 on board a rail vehicle or locomotive. The main reservoir 154 is fluid communication with a tractive effort system 156, such as that described above, through a pathway 158 having a continuously variable orifice 160 therein. The size of the continuously variable orifice 160 is controllable by a control unit 162. In operation, when use of the tractive effort system 106 is necessary to increase tractive effort, the pressure within the main reservoir 154 is continuously monitored and the size of the variable orifice 160 is varied in order to maintain the pressure in the main reservoir 154 above a predetermined lower threshold pressure. In an embodiment, the lower threshold pressure is approximately 110 psi. In particular, the size of the orifice is adjusted based on the available main reservoir pressure. As discussed above, maintaining the pressure within the main reservoir 154 above a lower threshold, namely 110 psi, is necessary to ensure that there is sufficient pressure to be utilized by other functional systems within the consist. In an embodiment, the size of the orifice is controlled by a continuously variable orifice valve.

In other embodiments, other flow control devices may be utilized to control the flow of air from the main reservoir to a tractive effort system in order to maintain a predetermined lower threshold pressure in the main reservoir. For example, the present invention contemplates the use of position displacement and/or vein valve devices to allow variable flow that enables the system to maximize air flow at any given time. In yet another embodiment, a secondary compressor may be utilized to either solely supply air to the tractive effort system, to supplement the compressed air supplied by the main reservoir, or to supply air to the main reservoir to maintain the pressure therein above the predetermined lower threshold.

Figure 9:
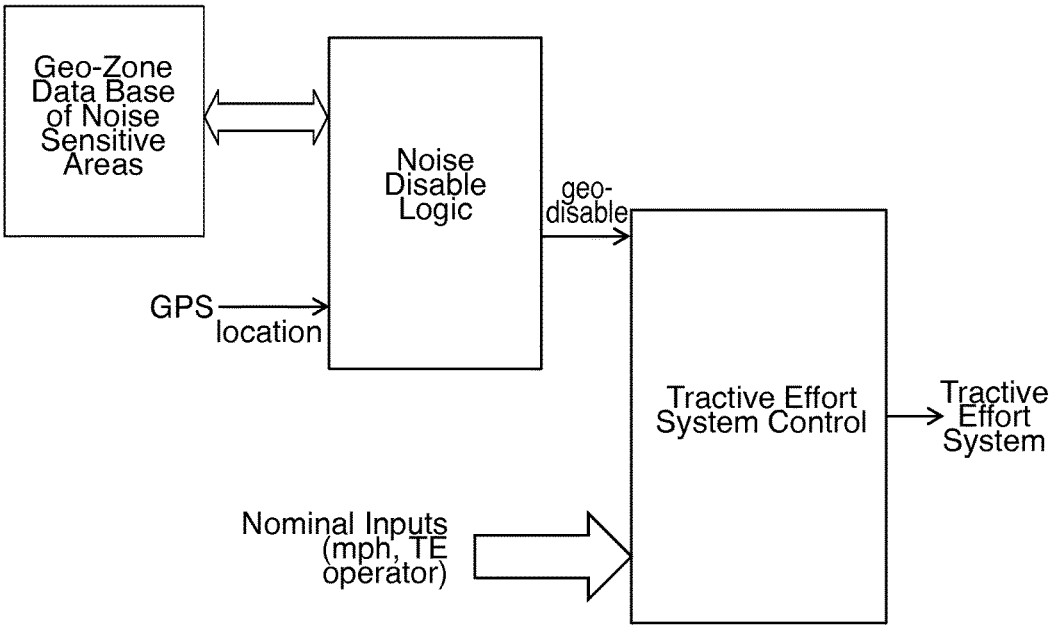
FIG. 9 is a block diagram illustrating the implementation of a smart-disable control strategy for a noise-sensitive area, according to an embodiment of the present invention.

Adhesion control systems and methods according to the present invention also provide the ability to disable a tractive effort system(s) within a consist in cases where enablement of the tractive effort system may be undesirable. For example, it may be desirable to disable the tractive effort system(s) in situations where operation of the system(s) may have a negative impact on locomotive performance. In an embodiment, the control unit may be configured to disable the tractive effort enhancement system(s) when one or more adverse conditions are present. In particular, the control unit on a locomotive, such as a lead locomotive, may automatically disable the tractive effort system on-board the locomotive in an area where the audible noise generated during use of the tractive effort system is objectionable. For example, information regarding residential or noise-sensitive areas may be stored in memory of a control unit and GPS may be utilized to monitor the geographical position of a consist. When the consist approaches an area stored in memory as being a noise-sensitive area, the control unit may automatically suspend use or disable the tractive effort system. FIG. 9 is a block diagram illustrating the implementation of a smart-disable control strategy wherein the adverse condition is a noise-sensitive area. (Generally, "adverse" condition refers to a condition which is designated as a basis for control of the tractive effort system, which may include turning off or disabling the tractive effort system.)

Figure 10:
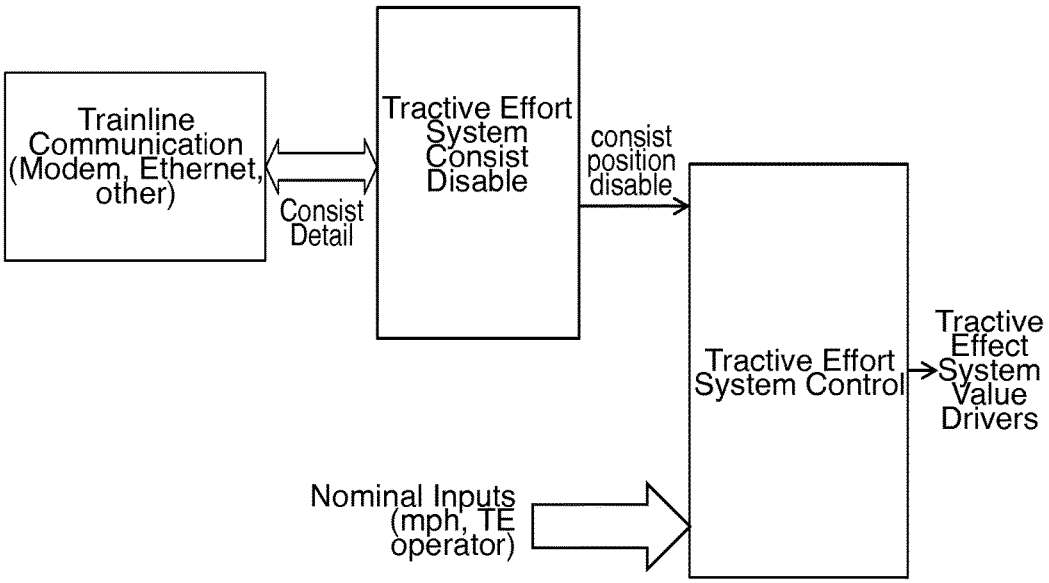
FIG. 10 is a block diagram illustrating the implementation of a smart-disable control strategy for a tractive effort system having minimal positive impact, according to an embodiment of the present invention.

In another embodiment, the control unit may disable the tractive effort system in a consist position where an active tractive effort system may have minimal positive or even negative impact on overall consist tractive effort (e.g., due to the location of a consist on grade and the position of the tractive effort system within the consist). FIG. 10 is a block diagram illustrating the implementation of a smart-disable control strategy wherein the adverse condition is for consist characteristics that translate to the tractive effort system having a minimal positive impact.

Figure 11:
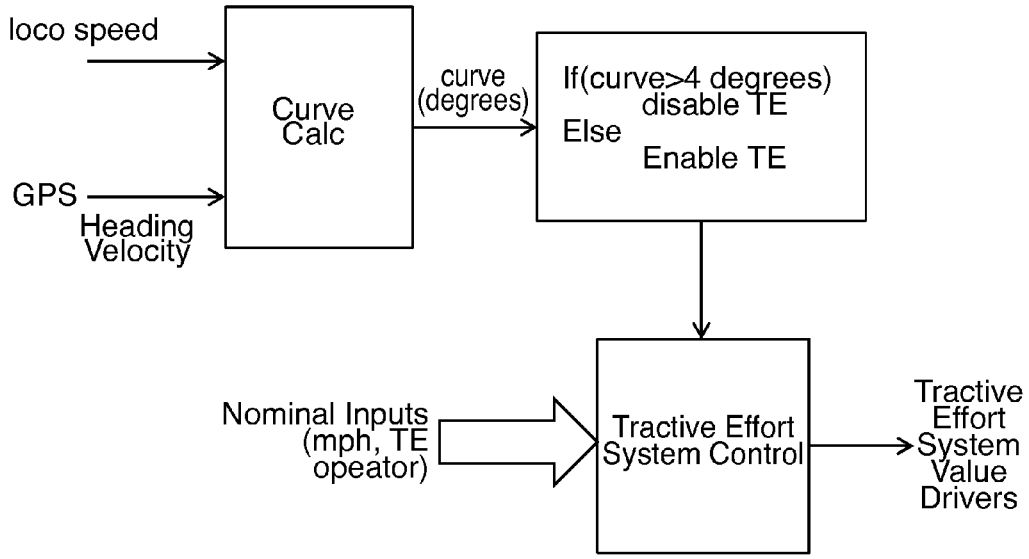
FIG. 11 is a block diagram illustrating the implementation of a smart-disable control strategy based on GPS heading information, according to an embodiment of the present invention.

In other embodiments, the control unit may be configured to disable the tractive effort system when the locomotive on which the tractive effort system is configured is traversing a curve of a sufficiently small radius to cause reduced performance. As will be readily appreciated, reduced performance may be due to, for example, the misalignment of the nozzle of the tractive effort system relative to the contact surface of the rail, among other factors. In connection with this embodiment, the radius of a curve may be sensed or calculated and/or various sensors may sense the position of the nozzle of the tractive effort system relative to the rail. These sensors may transmit data to the control unit and the control unit may disable the tractive effort system when misalignment of the nozzle with the contact surface of the rail is sensed. In addition, track data representing a curvature of the track at various locations may be stored in memory, and the control unit may be configured to disable the tractive effort system when the consist travels through these stored locations, as determined by GPS. FIG. 11 is a block diagram illustrating the implementation of a smart-disable control strategy based on GPS heading information. As shown therein, in an embodiment, locomotive speed and heading velocity is input into the control system. A curve calculation is carried out to determine the amount of curve in the track. If the curve is greater than approximately 4 degrees, the tractive effort system is disable. If the curve is less than approximately 4 degrees, the tractive effort system is enabled.

Figure 12:
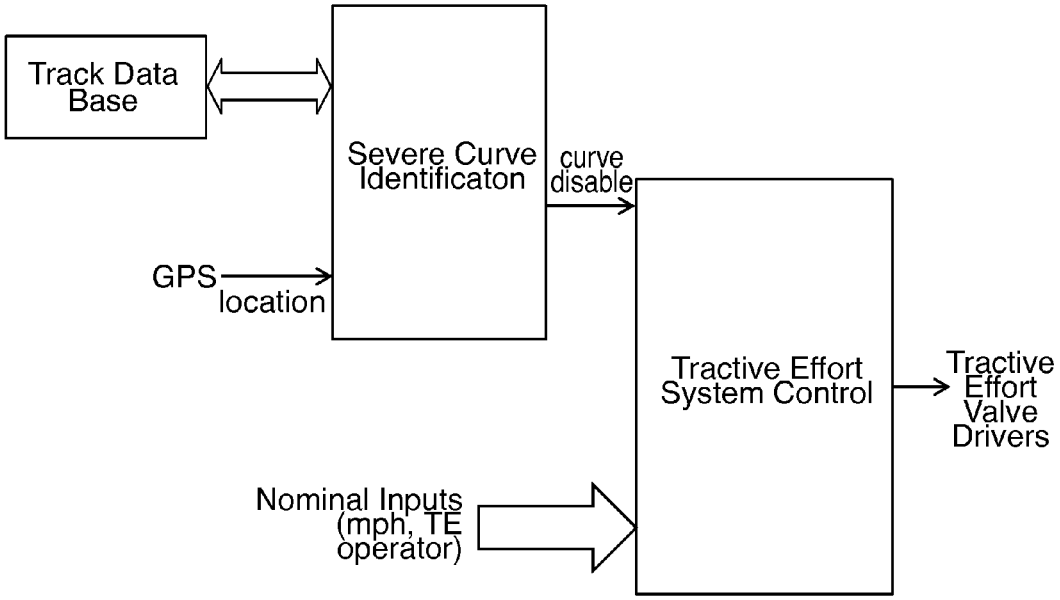
FIG. 12 is a block diagram illustrating the implementation of a smart-disable control strategy based on GPS location information, according to an embodiment of the present invention.

Similarly, FIG. 12 is a block diagram illustrating the implementation of a smart-disable strategy based on GPS location information and a track database. As shown therein, under this method, information regarding the curvature of a track at various locations along a route of travel is stored in memory. GPS is utilized to sense a location of the consist such that when the consist is in a location where a "severe" curve is known to exist, the tractive effort system will be disable by the control unit. As used herein, "severe curve" means a curve greater than approximately 4 degrees.

Figure 13:
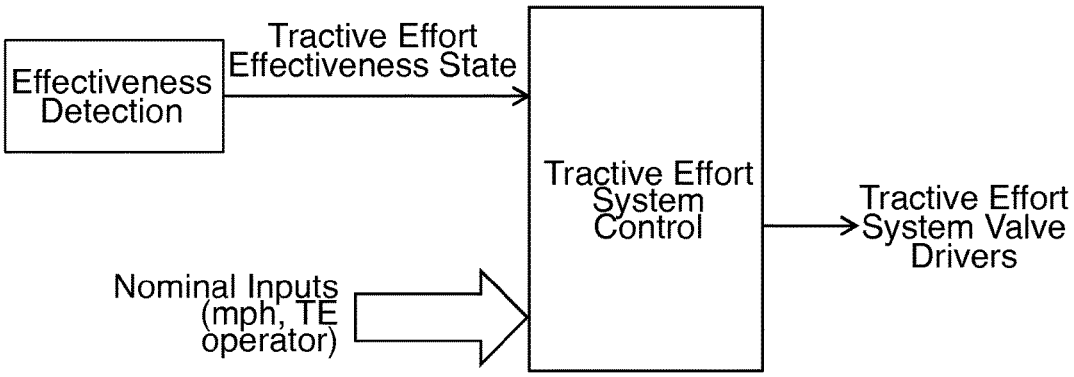
FIG. 13 is a block diagram illustrating the implementation of a smart-disable control strategy based on tractive effort system effectiveness, according to an embodiment of the present invention.

In yet other embodiments, the control unit may be configured with an adaptive control strategy capable of "learning" of a negative impact that enablement of a tractive effort system may have. Causes of negative impact include adverse weather conditions that are found to disturb the normally positive impact of a tractive effort system such as snow on the roadbed (which could blow up on the rail if the system were enabled) or cold temperatures (which may interact with the air blast from the nozzle) to cause a freezing of moisture on the rail). Other adverse conditions may include unusual dust or debris on the roadbed which may be blown onto the track by the system to reduce adhesion. FIG. 13 is a block diagram illustrating the implementation of a smart-disable strategy wherein the control unit disables the tractive effort system if a negative impact of the tractive effort system is detected or measured. In particular, as shown in FIG. 13, the control unit may be configured to disable the tractive effort system if effectiveness of the system does not reach a predetermined threshold. Systems and methods for determining effectiveness of a tractive effort system are discussed hereinafter.

In connection with the adhesion control systems and methods described above, the tractive effort enhancement systems are configured to automatically enable or disable when needed to produce an increase in tractive effort in dependence upon tractive effort position within a consist, sensed track conditions, sensed position of the consist, etc. In certain situations, however, it is also desirable to provide a means for an operator to manually enable one or more tractive effort systems on the consist prior to the control unit automatically enabling such systems. That is, it is sometimes desirable to manually enable a tractive effort system regardless of any automatic control functionality, such as that disclosed hereinbefore. As will be readily appreciated, this may be advantageous where an operator recognizes a rail condition visually, based on past experiences or other reasoning. Moreover, an operator may need to quickly and/or momentarily disable the tractive effort system(s) due to special circumstances such as to avoid debris or to avoid kicking up loose particles or debris on the road bed that could damage the locomotives or other nearby equipment.

Figure 14:
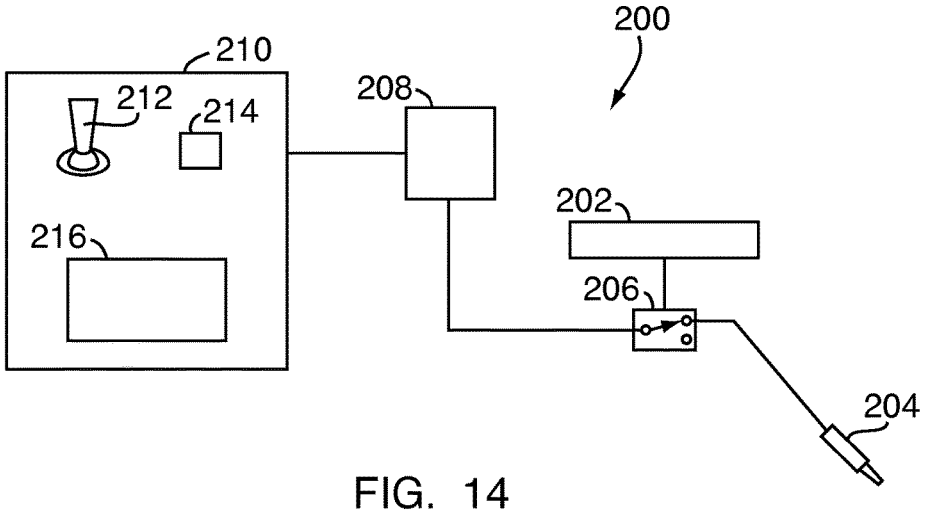
FIG. 14 is a schematic drawing of a tractive effort system having an operator interface, according to an embodiment of the present invention.

In an embodiment, a tractive effort system 200 having an operator interface is provided. As shown in FIG. 14, the tractive effort system 200 may be substantially similar to the tractive effort systems disclosed above and includes a supply of compressed air, such as a main reservoir 202 on-board a locomotive or a MRE pneumatic trainline, a nozzle 204 fluidly coupled to the main reservoir 202 for directing a high flow of air to a contact surface of the rail, a control valve 206 for selectively enabling or disabling the flow of compressed air from the main reservoir 202 to the nozzle, and a control unit 208 electrically coupled to the control valve 206 for controlling the valve 206, and thus the tractive effort system, between its enabled state and disabled state. As shown in FIG. 14, an operator interface 210 is electrically coupled to the control unit 208.

The operator interface 210 includes a momentary disable switch 212 and a monostable button 214. In an embodiment, the momentary disable switch 212 may be a hardware spring return mono-switch which is biased to an "enable" position in which tractive effort system 200 is controlled automatically in accordance with the control logic and methods disclosed above. The momentary disable switch 212 is movable against the bias by an operator to a "disable" position in which a signal is sent to the control unit 208, and thus to the valve 206 of the tractive effort system 200, to disable the tractive effort system. In an embodiment, an operator must hold the switch 212 in the "disable" position continuously to maintain the tractive effort system in the manually disabled state. If the operator releases the momentary disable switch 212, the switch springs back to the "enable" position wherein automatic control of the tractive effort system 200 by the control unit 208 is resumed. As will be readily appreciated, the momentary disable switch 212 may be useful in situations where an operator wishes to disable the air blast to the rail for a short period of time, such as when crossing a public roadway or the like.

Figure 15:
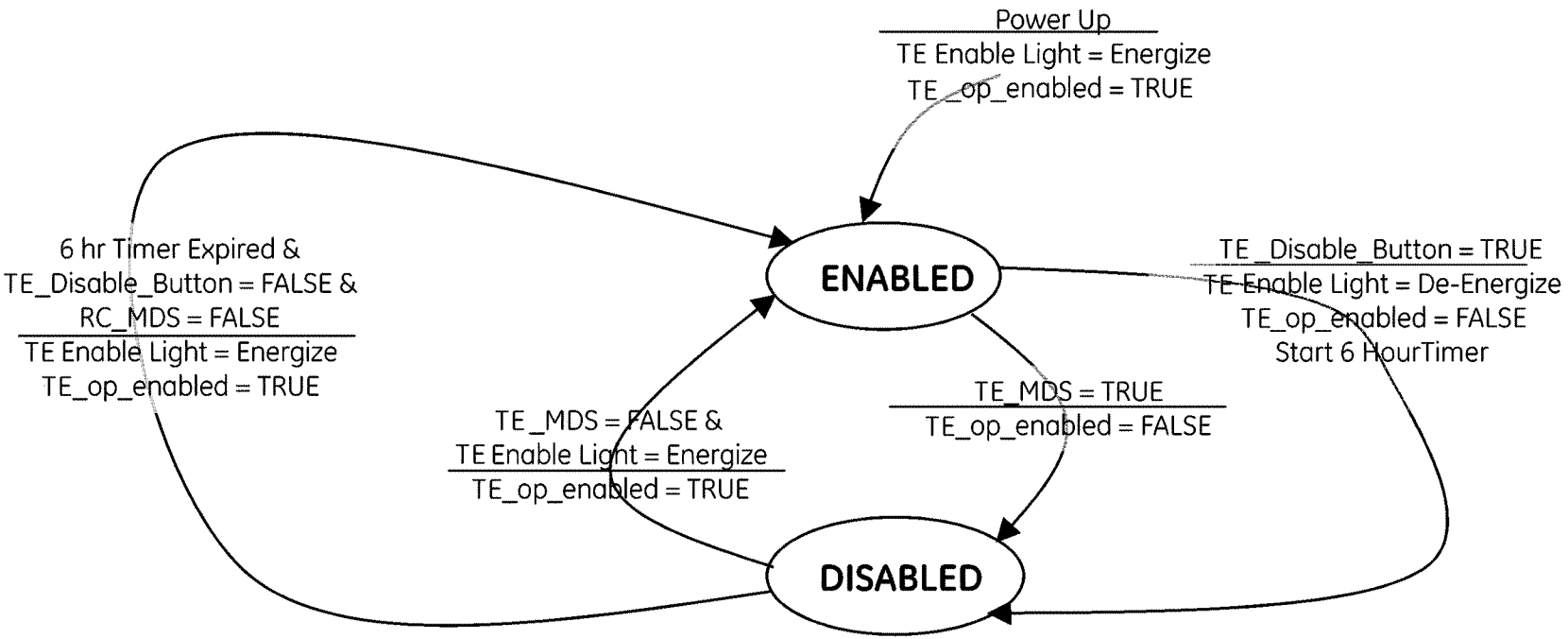
FIG. 15 is a state machine diagram illustrating the response of a tractive effort control system to operator inputs, according to an embodiment of the present invention.

The monostable button 214 is configured to toggle the state of the tractive effort system 200 between "enabled" and "disabled" when pressed by an operator. The state, whether enabled or disabled, may be displayed to the operator on a display 216. The indication to the operator of the disabled or enabled state of the tractive effort system 200 may be in the form of a light or screen icon on the display 216. In an embodiment, the indication may be a dial indicator or audio indicator, such as an audible tone. In an embodiment, the control unit 208 is configured to control the tractive effort system 200 back to its enabled state after at least one of a designated time has elapsed, a designated distance has been traversed, a designated throttle transition has occurred, the direction hand has been centered, a manual sand switch has been pressed or changed state, a certain vehicle speed change or level has occurred, the locomotive is within a certain geographical region, certain predetermined locomotive power or tractive effort levels have been attained, and/or certain other operator actions have been detected or sensed. FIG. 15 is a state machine diagram illustrating how the control unit 208 responds to direct operator inputs (i.e., the momentary disable switch 212 and monostable button 214) to control operation of the tractive effort system 200. In this implementation, a 6 our timer or a control system power-up is used to resent the tractive effort system 200 to an enabled state.

As discussed above, tractive effort systems in accordance with the present invention may, in addition to having a high-flow rate compressed air nozzle, may include a sanding nozzle for distributing sand or tractive material to the contact surface of the rail. Such a system was described above with reference to FIG. 4. As will be readily appreciated, the tractive material/sand may be mixed with a flow of pressurized air and driven at high velocity onto the rail to increase tractive effort, or may be simply deposited onto the contact surface of the rail without being entrained in a flow of pressurized air. Indeed, sanding has been commonly used in the rail industry to enhance the friction between the wheel/rail interface through sanding at the contact surface of the rail. Customarily, sand or other tractive material is applied in front of an axle in wet rail conditions or in other conditions where slippage may occur. Known sanding strategies include "automatic sand," wherein sand is automatically applied in front of both trucks of a locomotive, "manual lead," wherein sand is applied in front of the leading locomotive axle only and is manually enabled by an operator, and "manual trainline," wherein sand is applied in front of both trucks of all locomotives within the consist and is manually enabled by an operator.

With improvements in tractive effort systems, such as the improvements contemplated by the adhesion control systems and methods of the present invention, higher tractive effort may be attained than was previously possible. These improvements in tractive effort may be leveraged to reduce the amount of sand used. As will be readily appreciated, reducing the amount of sand used is desirable, as it reduces railroad capital expense. Accordingly, the present invention also provides a control system and method that reduces the amount of sand or tractive material utilized.

In an embodiment, a system for controlling a consist of rail vehicles includes a tractive effort system on-board a rail vehicle. The tractive effort system may be of the type disclosed above in connection with FIG. 4 having both air blast and sand dispensing capabilities. In other embodiments, the sand dispensing may be separate from the compressed air pathway, as discussed above. A control unit, such as that disclosed above, is electrically coupled to the rail vehicle and is configured to control the tractive effort system to dispense both tractive material/sand, sand only or air only. In an embodiment, the control unit may include a processor having a control strategy stored in memory that is executable to provide a high-flow jet of compressed air as a preference before applying sand to the rail.

According to an embodiment of the present invention, for a consist utilizing an "automatic sand" strategy, the control unit may configured to monitor slip, individual axle tractive effort and overall locomotive tractive effort and horsepower, as hereinafter discussed. The control unit may include a control strategy wherein sand is enabled as a backup to compressed air only as a function of at least one of locomotive speed, locomotive tractive effort, time since the air only mode was activated, distance traversed since the tractive effort system was activated, geographical location, operator input and measured or inferred tractive effort reservoir levels. In an embodiment, the control system may be configurable to realize more sand savings as opposed to high tractive effort, and vise-versa.

Figure 16:
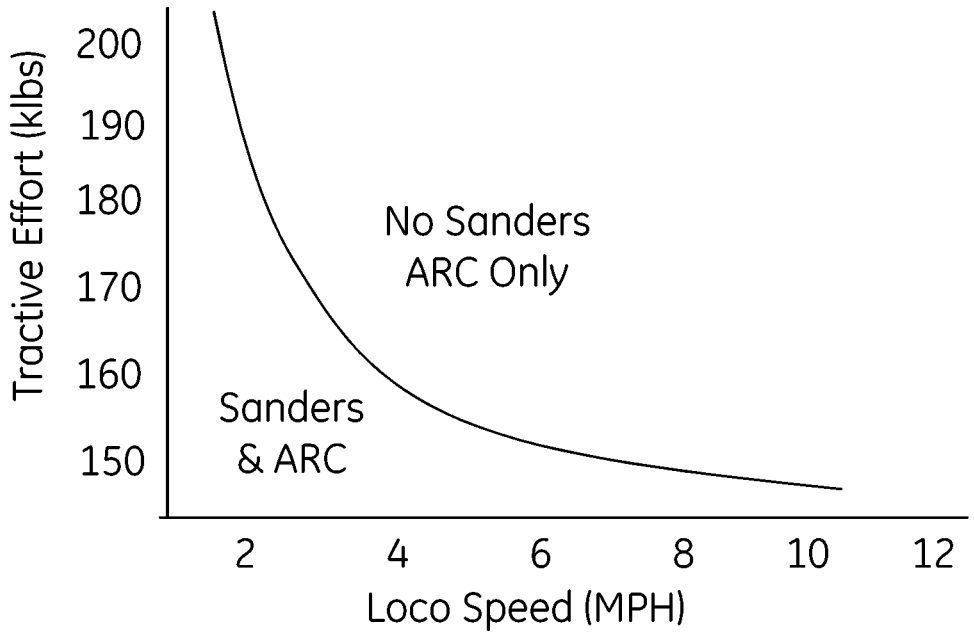
FIG. 16 is a graph FIG. 16 illustrating tractive effort threshold as a function of locomotive speed.
Figure 17:
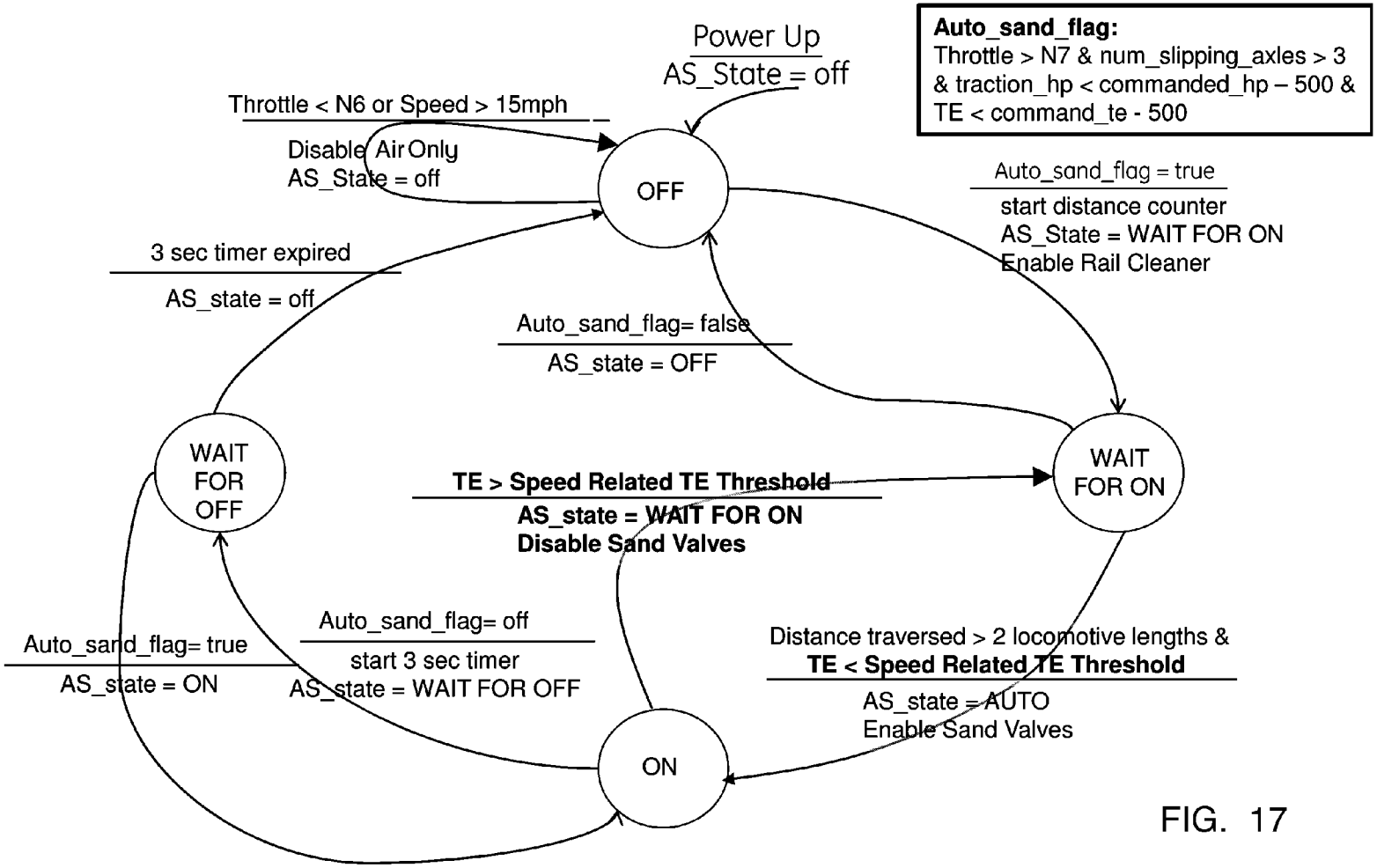
FIG. 17 is a state machine diagram illustrating a sand reduction control strategy for a tractive effort system, according to an embodiment of the present invention.

In yet another embodiment of a system for reducing the amount of sand/tractive material utilized, the control system may be configured to delay automatic sanding after the air only blast as long as a certain level of tractive effort is attained. This tractive effort threshold may be a function of a speed such that as the consist slows toward a stall or is slipping, a more aggressive sand application is initiated by the control unit/control system. In an embodiment, a tractive effort threshold is input into the control unit or stored in memory. Above this tractive effort threshold, auto-sanding is not initiated. This threshold may be automatically increased as speed is reduced so that at some lower speed, sand is always applied if there are any axles on the locomotive which are limited in tractive effort due to wheel slip. FIG. 16 illustrates an exemplary tractive effort threshold as a function of locomotive speed. FIG. 17 is a state machine diagram illustrating how the tractive effort threshold may be utilized by the control unit to control operation of the tractive effort system (i.e., sand only, air only or sand and air) in order to reduce the amount of sand or tractive material used.

Figure 18:
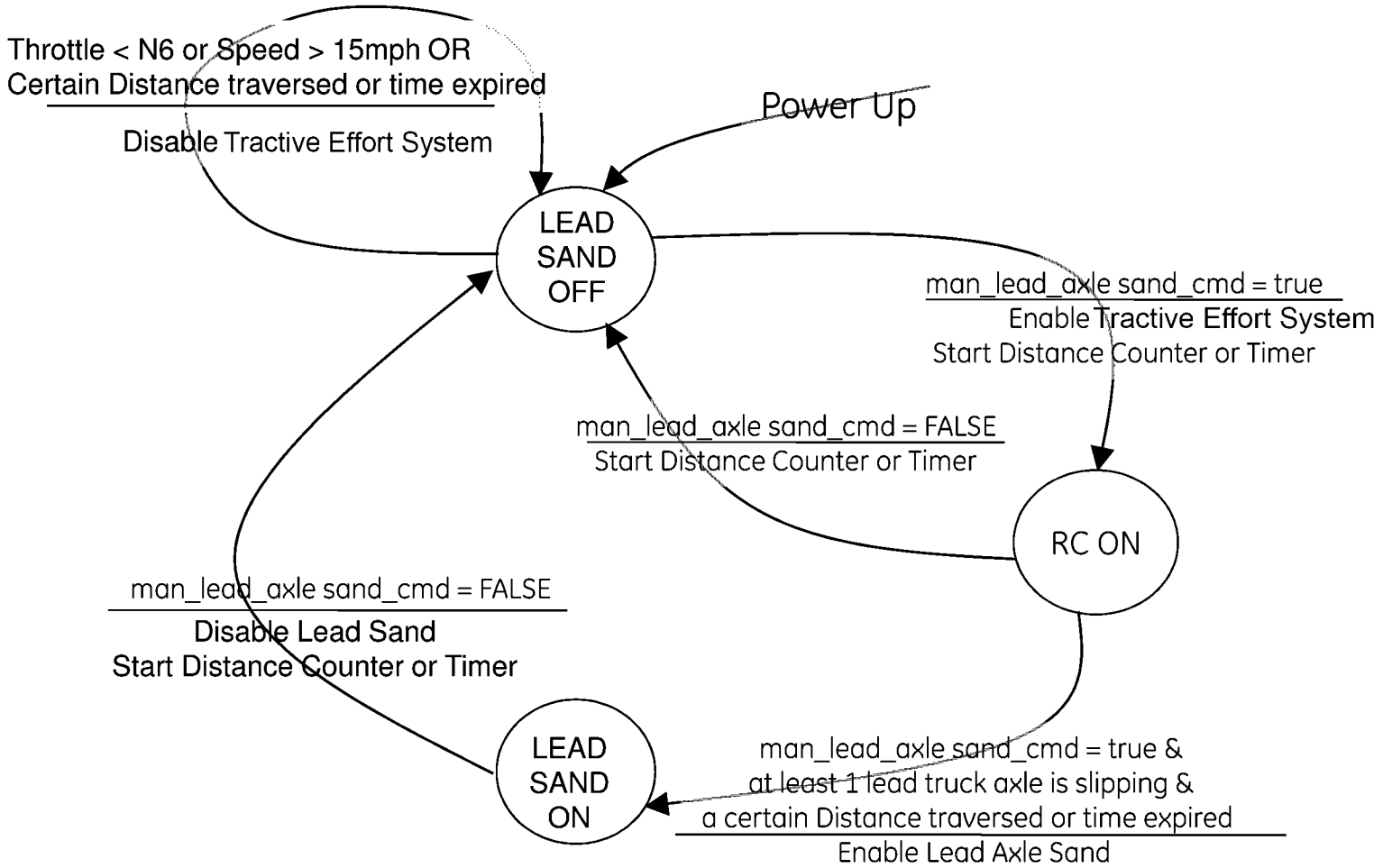
FIG. 18 is a state machine diagram illustrating another sand reduction control strategy for a tractive effort system, according to an embodiment of the present invention.

According to another embodiment of the present invention, a control system and method for reducing the amount of sand utilized under a "manual lead" sand strategy is provided. As discussed above, the manual lead axle sand command is typically issued when an operator wants to sand the lead axle independent of the automatic sand state. FIG. 18 is a state machine diagram illustrating an exemplary sand reduction control strategy for manual lead axle sanding. As shown therein, upon initiation of "manual lead" sanding, the air blast mode of the tractive effort system is automatically initiated as well. Once the air blast mode of the tractive effort system is enabled, it is maintained in the enabled state even if the operator input to the enable "manual lead" sand is removed. In this embodiment, the control unit is configured to deactivate or disable the tractive effort system (i.e., cease air blast) after some time or some distance. In another embodiment, the control unit is configured to deactivate or disable the tractive effort system (i.e., cease air blast) if the consist is past the apparent grade or slippage challenge as indicated by realized high train speeds or a throttle reduction. The embodiments of the present invention relating to sand reduction systems and methods disclosed herein are particularly applicable to situations where the throttle is in the "motoring position." It is contemplated, however, that similar control strategies for sand reduction are applicable in "dynamic braking modes" as well.

Figure 19:
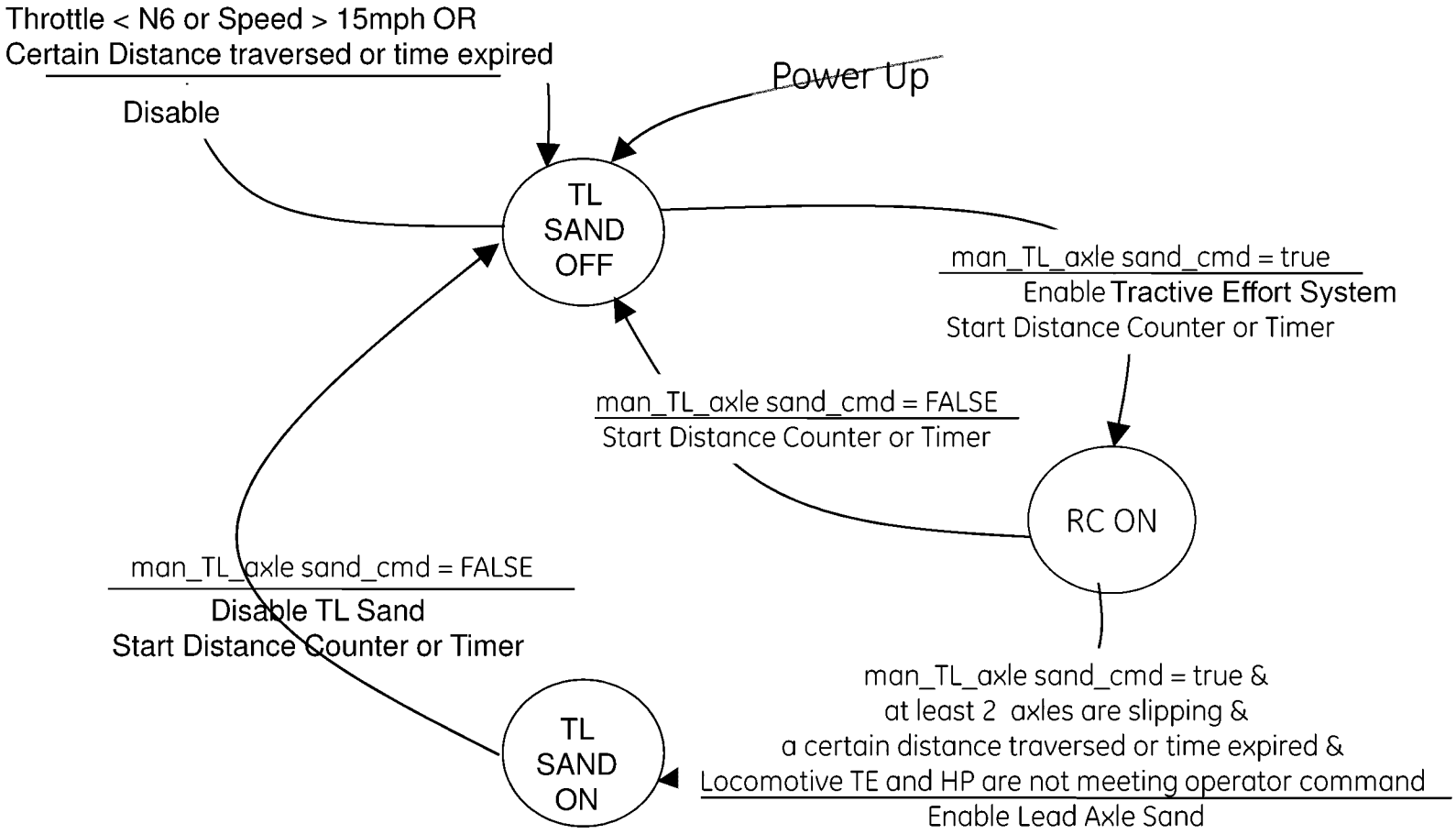
FIG. 19 is a state machine diagram illustrating another sand reduction control strategy for a tractive effort system, according to an embodiment of the present invention.

According to another embodiment of the present invention, a control system and method for reducing the amount of sand utilized under a "manual trainline" sand strategy is provided. As discussed above, the manual trainline sand command is typically issued when an operator desires to sand the lead axle on each truck of the trainline in addition to or independent of automatic sand. FIG. 19 is a state machine diagram illustrating an exemplary sand reduction control strategy for manual trainline sanding. As shown therein, upon initiation of "manual trainline" sanding, the air blast mode of the tractive effort system is automatically initiated as well. Once the air blast mode of the tractive effort system is enabled, it is maintained in the enabled state even if the operator input to the enable "manual trainline" is removed. In this embodiment, as with the sand saving method under "manual lead" sanding disclosed above, the control unit is configured to deactivate or disable the tractive effort system (i.e., cease air blast) after some time or some distance, or if the consist is past the apparent grade or slippage challenge as indicated by realized high train speeds or a throttle reduction.

In connection with the control systems and methods for high flow rate tractive effort systems disclosed above, the present invention also relates tractive effort diagnostic systems and methods. In particular, the present invention is also directed to systems and methods for detecting clogs in a tractive effort system, detecting leaks in a tractive effort system and for measuring or detecting the effectiveness of a tractive effort system. As will be readily appreciated, diagnosing the "health" of a tractive effort system or systems on board a rail vehicle consist is important to achieving and maintaining optimum tractive effort during travel. As will be readily appreciated, if a tractive effort system is clogged or has a leak, it may function less than optimally and provide less than optimal results. Moreover, tractive effort control systems may utilize information regarding the "health" of the tractive effort systems to generate and execute a more tailored control strategy therefor.

In one embodiment, a system and method for detecting clogs in a tractive effort system on-board a rail vehicle is provided. As discussed above, the tractive effort systems contemplated by the present invention utilize substantially high flow rates to clear debris from the rail of a track to increase tractive effort. These high flow rates used allow significant reductions in flow to be detected. In particular, the impact of air usage from enablement of a tractive effort system and the load on the air compressor to replace the compressed air in the main reservoir of a given rail vehicle or locomotive may be monitored.

As will be readily appreciated, any system that utilizes air from the main reservoir on-board a locomotive causes the pressure within the main reservoir to suddenly drop when the system is enabled. This is a direct result of compressed air being drawn from the reservoir faster than the air compressor can replace it. As the tractive effort systems having high flow air jets contemplated by the present invention are large consumers of compressed air, enablement of the system immediately results in a large, sudden and detectable drop in the pressure in the main reservoir. As the pressure in the main reservoir drops, the air compressor is activated to replace the compressed air within the main reservoir.

Figure 20:
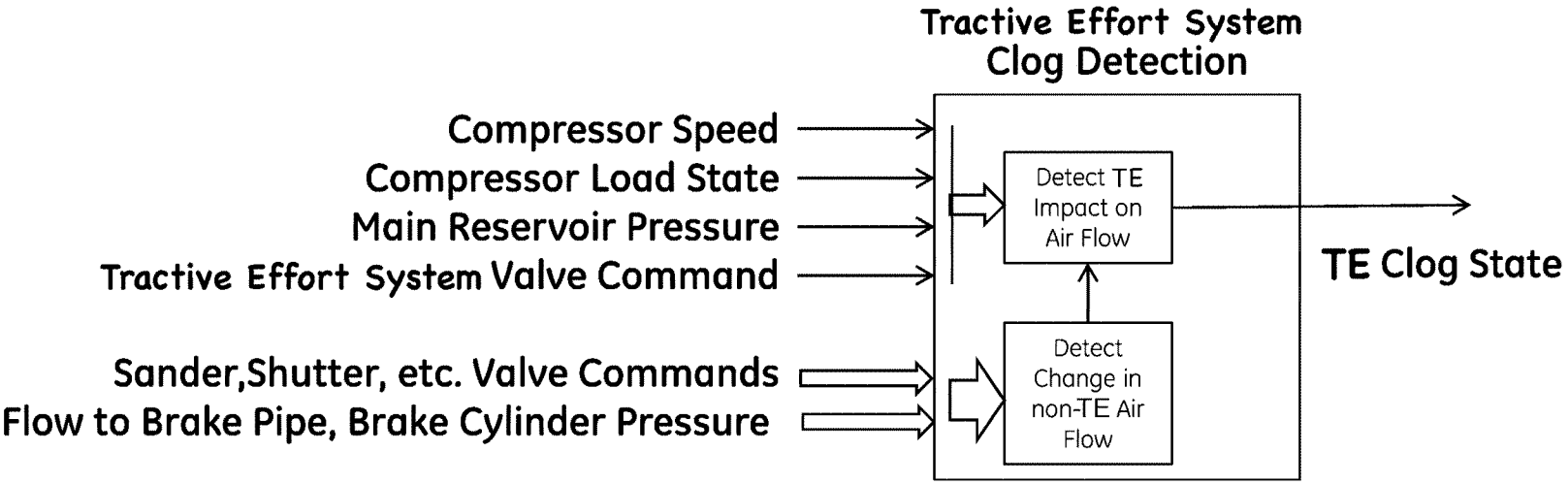
FIG. 20 is a block diagram illustrating a method for detecting clogs in a tractive effort system, according to an embodiment of the present invention.
Figure 21:
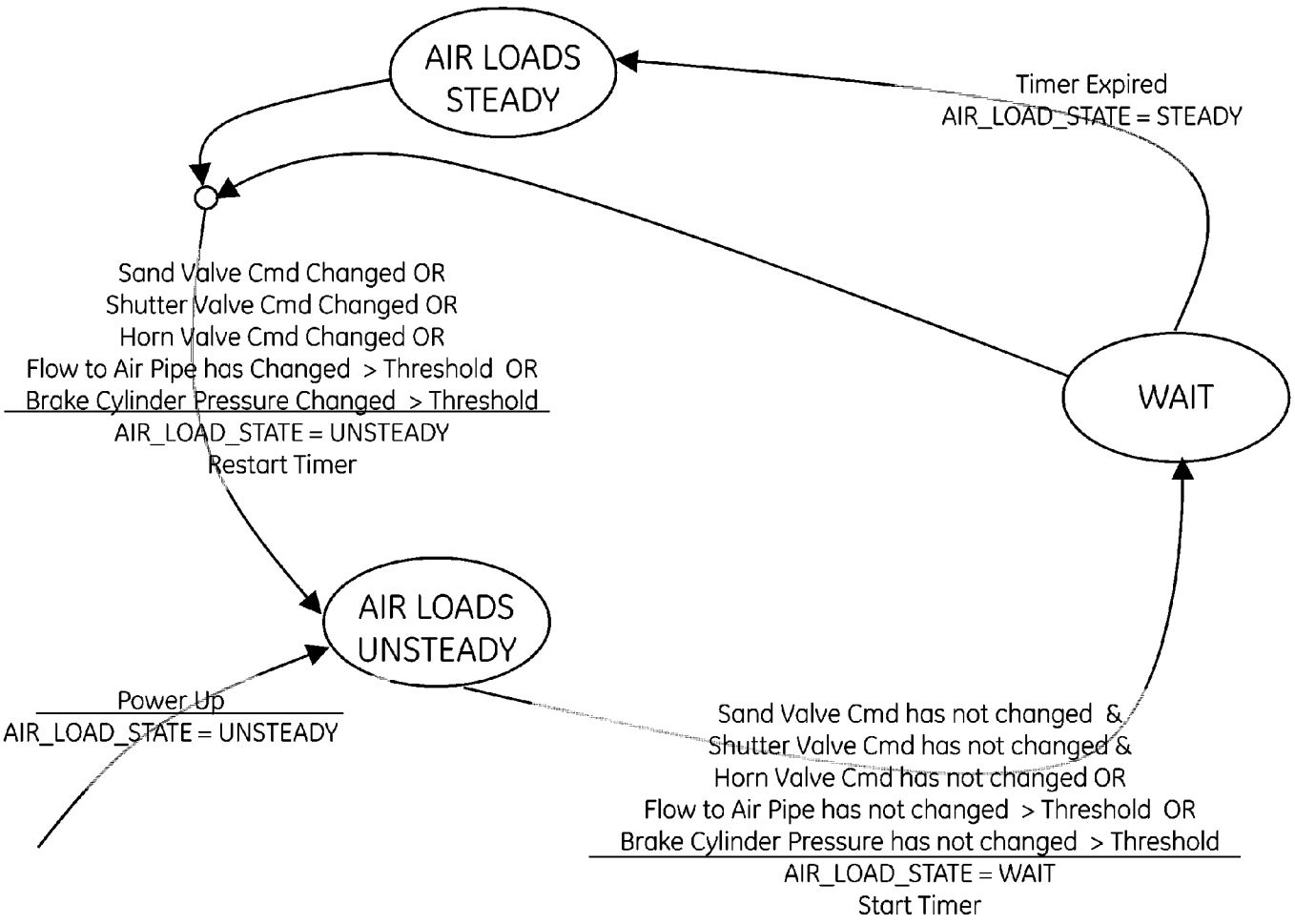
FIG. 21 is a state machine diagram illustrating a method for detecting the change in non-tractive effort system air flow, according to an embodiment of the present invention.
Figure 22:
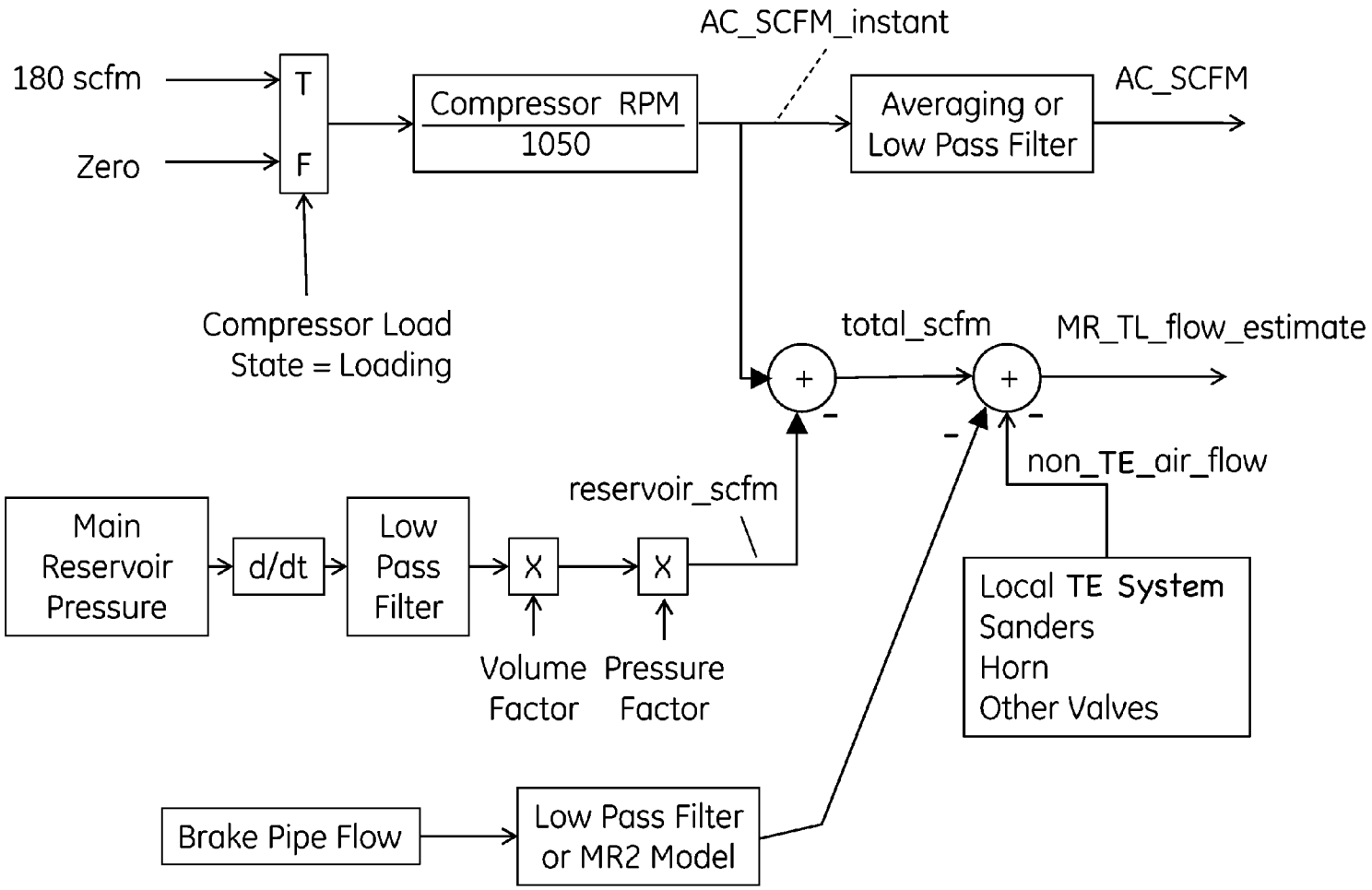
FIG. 22 is a flow diagram illustrating a method for estimating air compressor and tractive effort system flow, according to an embodiment of the present invention.
Figure 23:
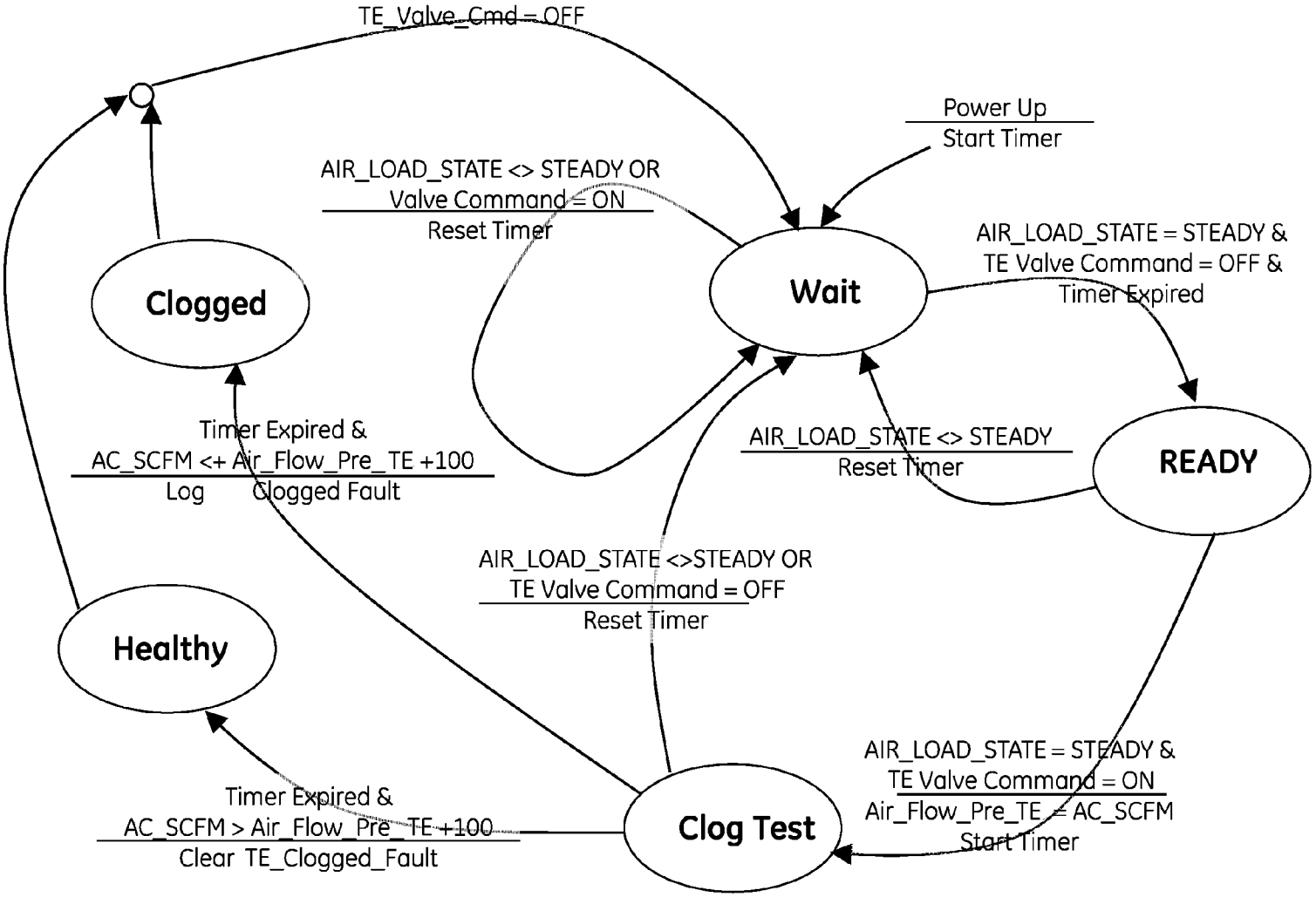
FIG. 23 is a state machine diagram illustrating a method for detecting clogs in a tractive effort system, in accordance with an embodiment of the present invention.

In an embodiment, as illustrated in FIG. 20, a method for detecting clogs in a tractive effort system on-board a rail vehicle includes comparing compressor air flow before ("baseline") and after ("secondary") the activation of the tractive effort system. Importantly, however, because there are other systems on board the consist that utilize compressed air, such as air brakes, sander control valves, horns, and other actuators, this flow comparison is best made when the state of these other devices is constant (and thus the air compressor load state is constant). In an embodiment, the compressor flow may be estimated in normalized volume rates. In another embodiment, the compressor flow may be estimated in mass flow based on compressor displacement and speed. FIG. 21 is a state machine diagram illustrating a method for detecting the change in non-tractive effort system air flow, i.e., for determining when the state of all air-consuming devices is constant and thus the air compressor load state is steady. FIG. 22 is a flow diagram illustrating a method for estimating air compressor and tractive effort system flow, as described above. FIG. 23 is a state machine diagram illustrating a method for detecting clogs in a tractive effort system.

As best shown in FIG. 23, a method for detecting clogs first includes the step of determining an air flow rate from the compressor to the main reservoir and a corresponding compressor load value under steady conditions. As used herein, steady conditions is intended to mean when the state of other air consuming devices is generally constant. This initial air flow rate and compressor load value/air load state may be referred to as a "baseline" air flow rate and baseline compressor load value/air load state. Once the air load state is steady, the tractive effort system is enabled by the control system for a predetermined period of time. At the expiration of this period, a secondary air flow rate and/or compressor load value is then assessed and compared to the baseline air flow rate and/or compressor load value. If the secondary air flow rate is greater than the baseline air flow rate plus a predetermined "buffer" (generally representing tractive effort system expected air flow), then the tractive effort system is diagnosed as "healthy" with respect to any clogs. If, however, the secondary air flow rate is less than the baseline air flow rate plus the "buffer," then the tractive effort system is diagnosed as "clogged." Based on this diagnosis, the control system may be configured to automatically disable the clogged tractive effort system and instead utilize another tractive effort system on-board another rail vehicle in its place.

In addition to detecting clogs within a tractive effort system by comparing compressor air flow before and after activation of the tractive effort system, system leaks may be diagnosed by detecting larger than expected compressor air flows when the system is activated as compared to when it is disabled. In an embodiment, the region where leaks can be detected is on the load side of the solenoid valve 50 as shown in FIG. 4. As will be readily appreciated, the detection of leaks within the system is important, as large leaks can tax the compressor to the point it cannot maintain system pressure above required levels.

Figure 24:
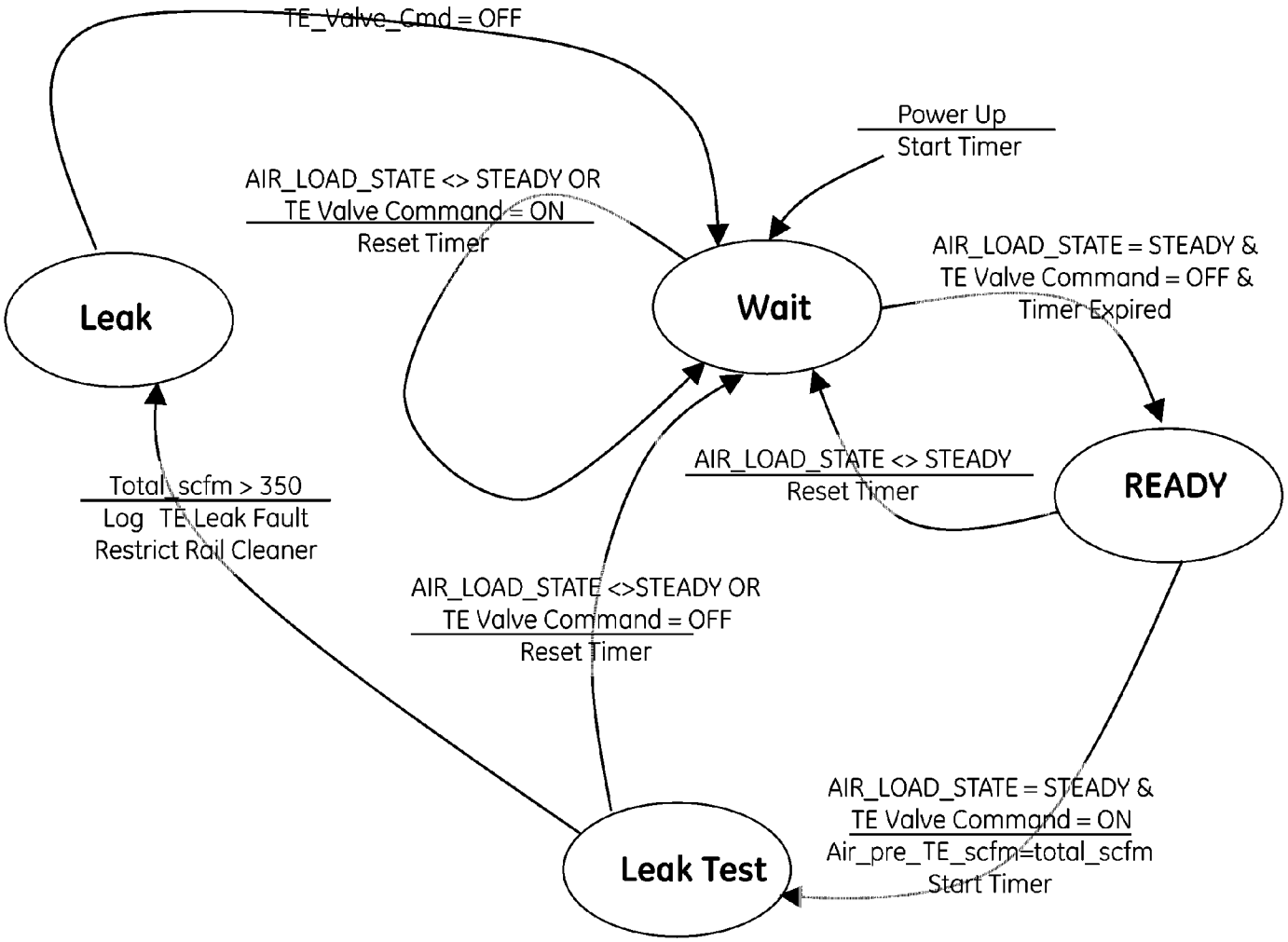
FIG. 24 is a state machine diagram illustrating a method for detecting leaks in a tractive effort system, in accordance with an embodiment of the present invention.

As illustrated by the state machine diagram of FIG. 24, a method for detecting leaks in a tractive effort system includes first ensuring that the air load state is "steady," as discussed above. Once the air load state is steady, the tractive effort system is enabled by the control system for a predetermined period of time. At the expiration of this period, a secondary air flow rate is measured. If the secondary air flow rate is greater than a predetermined threshold flow rate value based on the expected flow rate of the tractive effort system, a leak is diagnosed. If the secondary air flow rate is less than the predetermined threshold flow rate value, then the tractive effort system is diagnosed as "healthy" with respect to any leaks. If a leak is detected, the tractive effort system may be disabled or restricted in its use by the control system. In addition, based on this diagnosis, the control system may elect to utilize another tractive effort system within the consist in its place in accordance with the control logic described above.

In addition to the above, the present invention also provides a method for determining the effectiveness of a tractive effort system. In particular, the control system of the present invention is configured to automatically determine the impact of the tractive effort system on tractive effort and to take appropriate control action to accommodate the performance. As illustrated by the state machine diagram of FIG. 25, a method for determining the effectiveness of a tractive effort system includes enabling a tractive effort system for a predetermined travel distance. In an embodiment, the predetermined travel distance is at least 1 locomotive length. In an embodiment, the predetermined travel distance is more than 2 locomotive lengths. After the tractive effort system has been enabled for a predetermined travel distance, a first tractive effort is sampled, along with sand states, speed, notch, heading and curve measure. The tractive effort system is then disabled by the control system and a delay of approximately 2 locomotive lengths is initiated to allow for the impact of the tractive effort system to take effect. If speed has changed by more than approximately 2 miles per hour, notch has changed, or curvature has changed by more than approximately 3 degrees, then use of the tractive effort system is aborted. If not, a second tractive effort is sampled. The tractive effort of the system is then determined by subtracting the second tractive effort sampled value from the first tractive effort sample value. Depending on the outcome of this comparison, tractive effort system may be enabled once again to increase tractive effort.

Figure 25:
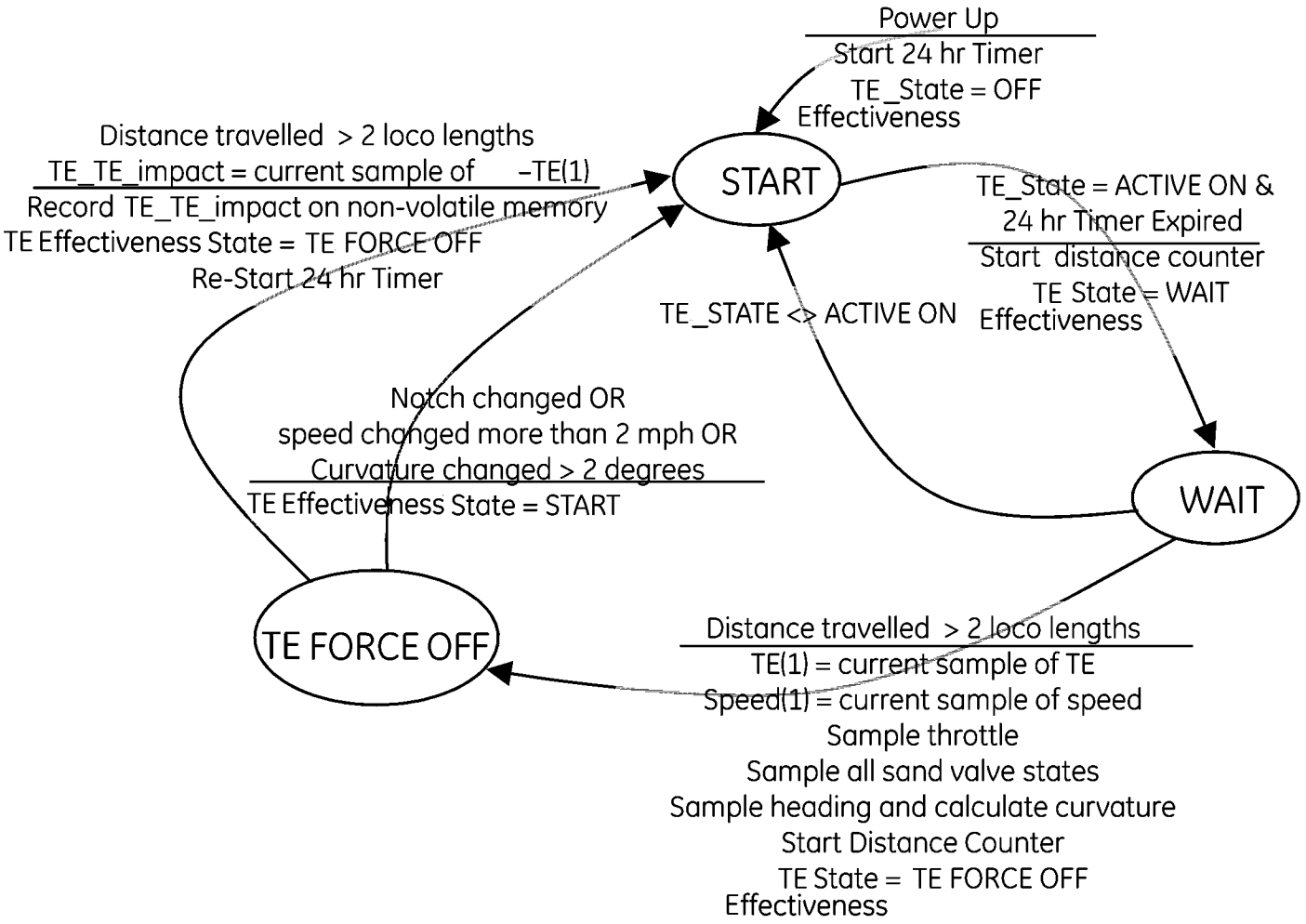
FIG. 25 is a state machine diagram illustrating a method for determining the effectiveness of a tractive effort system, in accordance with an embodiment of the present invention.
Figure 26:
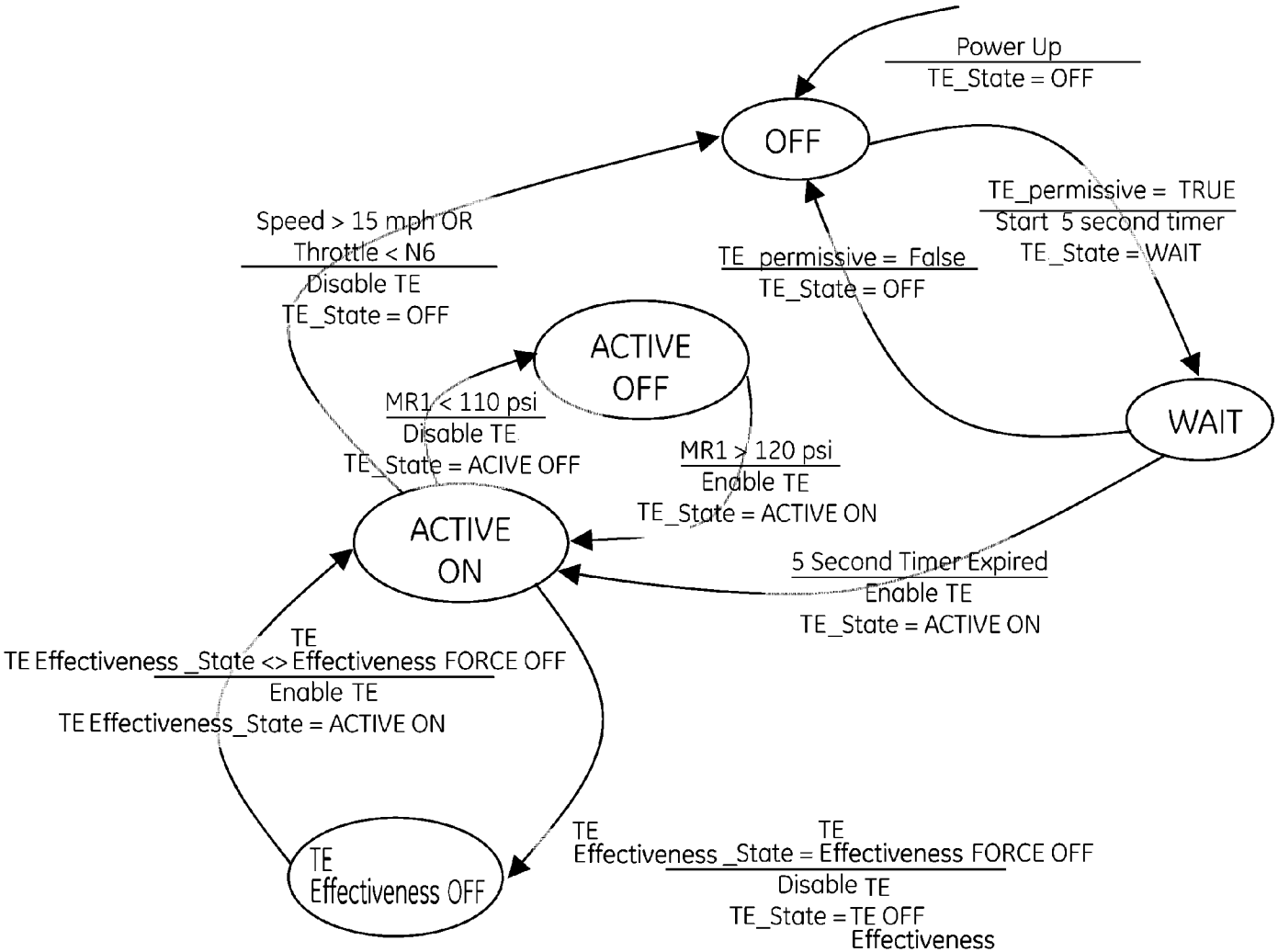
FIG. 26 is a state machine diagram illustrating a tractive effort system control strategy based upon a determined tractive effort system effectiveness, according to an embodiment of the present invention.

In an embodiment, the state machine for effectiveness detection illustrated in FIG. 25 may interact with a tractive effort system state machine, as shown in FIG. 26. In particular, this method for determining tractive effort system effectiveness may be utilized in connection with the smart-disable control strategy as shown in FIG. 13 and as discussed above. In this embodiment, if certain tractive effort system permissive conditions are met, such as speed is greater than approximately than 12 mph, throttle is approximately notch 7 or more, main reservoir pressure is greater than approximately 110 psi and either automatic or manual sand is enabled, then the tractive effort system is enabled after a predetermined delay. In an embodiment, the delay may be approximately 5 seconds. As shown therein, the tractive effort system may be maintained in its enabled state until the pressure in the main reservoir drops below approximately 110 psi. In an embodiment, the tractive effort system may be maintain in its enabled state until speed is greater than approximately 15 mph or throttle is approximately less than notch 6. Moreover, in an embodiment tractive effort system effectiveness may also be assessed and the system either disabled or maintained in an enabled state in dependence upon the determined effectiveness, as discussed above.

As will be readily appreciated, the ability to assess the effectiveness of a tractive effort system provides a number of advantages. In particular, assessment of the effectiveness provides performance information that can be used to aid in design improvements. In addition, defects or shortcomings in system effectiveness can be utilized to drive repair. Moreover, determining effectiveness of a tractive effort system allows a negative impact on tractive effort to be detected, such that a control action may be undertaken to disable the system until a period of time has elapsed or a change in location or rail condition has occurred, as hereinbefore discussed.

An embodiment of the present invention relates to a system for controlling a consist of rail vehicles or other vehicles. The system includes a control unit electrically coupled to a first rail vehicle in the consist, the control unit having a processor and being configured to receive signals representing a presence and position of one or more tractive effort systems on-board the first vehicle and other rail vehicles in the consist, and a set of instructions stored in a non-transient medium accessible by the processor, the instructions configured to control the processor to create a optimization schedule that manages the use of the one or more tractive effort systems based on the presence and position of the tractive effort systems within the consist. The control unit may be configured to maximize a supply of air to a lead-most tractive effort system. The control unit may configured to determine the presence of the one or more tractive effort systems on-board the rail vehicles in dependence upon at least one of air compressor speed and load state, reservoir pressure derivatives and a status of other loads within the rail vehicles. The control unit may be configured to detect the presence of a tractive effort system within the consist by estimating an air flow within a MRE pneumatic line. Moreover, the control unit may be configured to receive the signals representing the presence and position of one or more tractive effort systems on-board the rail vehicles via a communication link between the first rail vehicle and the other rail vehicles. The communication link may be a high-bandwidth communications link. The system may also include a compressed air reservoir fluidly coupled to one of the tractive effort systems for supplying compressed air, and the control unit may be configured to adjust the flow of compressed air from the reservoir to the tractive effort system to maintain a pressure within the reservoir above a lower threshold. The lower threshold may be approximately 110 psi. Alternatively, the control unit may be configured to enable one or more of the tractive effort systems until a pressure within the reservoir reaches a lower threshold pressure.

Another embodiment of the present invention relates to a method for optimizing a consist of at least first and second rail vehicles or other vehicles. The method includes the steps of determining a configuration of tractive effort systems within the consist and enabling the tractive effort systems in dependence upon the determined configuration to increase tractive effort. The method may also include the step of maximizing a flow of air to a lead-most tractive effort system. The step of determining the configuration of tractive effort systems within the consist may include estimating the flow of air through a MRE pneumatic line. Moreover, the method may include the step of adjusting a flow of air to one of the tractive effort systems to maintain a pressure within a compressed air reservoir above a lower threshold. The method may further include the step of, wherein the first and second rail vehicles each have a tractive effort system thereon, regulating the pressure in a compressed air reservoir of the second rail vehicle above approximately 140 psi (965 kPa) and regulating the pressure in a compressed air reservoir of the first rail vehicle above approximately 110 psi. The method may also include loading an air compressor to maximum flow.

Another embodiment of the present invention relates to a method of optimizing a flow of air to a tractive effort system of a rail vehicle or other vehicle. The method includes the steps of providing a supply of pressurized air from a reservoir to the tractive effort system, and varying the flow of air to the tractive effort system to maintain a pressure in the reservoir above a predetermined lower threshold. Varying the flow of air may include selectively directing the flow of air from the main reservoir through one of a first orifice and a second orifice in dependence on a detected air pressure in the reservoir, wherein the first orifice having a larger outlet area than the second orifice. Varying the flow of air may include selectively controlling a size of an orifice in an air flow path between the reservoir and a nozzle of the tractive effort system in dependence upon an available air pressure in the reservoir. The size of the orifice may be controlled by a continuously variable orifice valve. The pressure in the reservoir may also be maintained above the predetermined lower threshold through the use of a secondary dedicated air compressor.

Another embodiment of the present invention relates to a system for control of a rail vehicle or other vehicle. The system includes a tractive effort device having a nozzle positioned to direct a flow of air to a rail, a reservoir fluidly coupled to the tractive effort device for providing a supply of compressed air to the tractive effort device, and a control unit electrically coupled to the tractive effort device and configured to control a flow of compressed air from the reservoir to the tractive effort device in dependence upon an available pressure within the reservoir. The system may also include a continuously variable orifice positioned between the reservoir and the nozzle of the tractive effort device. With this configuration, the control unit may be further configured to control the size of the orifice in dependence upon the pressure within the reservoir. Moreover, the system may include a first pathway from the reservoir to the tractive effort device, the first pathway having a first orifice therein and a first control valve for selectively controlling a flow of air through the first orifice, and a second pathway form the reservoir to the tractive effort device, the second pathway having a second orifice therein and a second control valve for selectively controlling a flow of air through the second orifice, the second orifice being smaller than the first orifice. In this configuration, the control unit may be electrically coupled to the first and second control valves for selectively controlling the first and second control valves between a first state, in which air is permitted to flow therethrough, and a second state, in which air is prevented from flowing therethrough. The system may include a first air compressor fluidly coupled to the reservoir for supplying the reservoir with compressed air and a second air compressor configured to supply the reservoir with compressed air in dependence upon the available pressure within the reservoir.

Yet another embodiment of the present invention relates to a system for use with a vehicle having a wheel that travels on a surface, e.g., a rail vehicle having a wheel that travels on a rail. The system includes a tractive effort system including an air source for supplying compressed air and a nozzle fluidly coupled to the air source and configured to direct a flow of compressed air from the air source to a contact surface of the rail, and a control unit electrically coupled to the tractive effort system and configured to control the tractive effort system between an enabled state, in which compressed air flows from the air source and out of the nozzle of the tractive effort system, and a disabled state, in which compressed air is prevented from exiting the nozzle. The control unit is further configured to control the tractive effort system from the enabled state to the disabled state in dependence upon the presence of at least one adverse condition. The at least one adverse condition may be a geographic location of the rail vehicle, a curve radius of the rail below a predetermined radius threshold, the presence of at least one of snow, dust or debris on the a roadbed adjacent the rail, and/or determined ineffectiveness of tractive effort enhancement.

Yet another embodiment of the present invention relates to a method for controlling a rail vehicle or other vehicle. The method includes providing a tractive effort system having a nozzle for directing the flow of compressed air to the contact surface of a rail and disabling the tractive effort system when an adverse condition is detected. The adverse condition may be one of a geographic location of the rail vehicle, a curve radius of the rail below a predetermined threshold, a calculated ineffectiveness of the tractive effort system and a detection of debris on a roadbed adjacent the rail.

Another embodiment relates to a system for use with a vehicle having a wheel that travels on a surface, e.g., a rail vehicle having a wheel that travels on a rail. The system includes an air source for supplying compressed air, a nozzle fluidly coupled to the air source and configured to direct a flow of compressed air from the air source to a contact surface of the rail, a valve positioned intermediate the air source and the nozzle, the valve being controllable between a first state in which the compressed air flows from the air source to the nozzle, and a second, disabled state in which the compressed air is prevented from flowing to the nozzle, a controller for controlling the valve between the first state and the second, disabled state, and an operator interface electrically coupled to the controller, the operator interface including a momentary disable switch biased to a position that controls the valve to the first state and movable against the bias to control the valve to the second, disabled state. The operator interface may also include a monostable button actuatable to selectively toggle the valve between the first state and the second, disabled state. The controller may be configured to automatically control the valve to the first state after a predetermined period of time has elapsed, a certain distance has been traversed, a certain throttle transition has occurred, a certain vehicle speed change has occurred and/or a certain tractive effort level has been attained.

Another embodiment relates to a system for controlling a consist of vehicles having a plurality of wheels that travel on a surface, e.g., a consist of rail vehicles having a plurality of wheels that travel on a rail. The system includes a tractive effort system on-board a first rail vehicle. The tractive effort system includes a media reservoir capable of holding a tractive material, a tractive material nozzle in communication with the media reservoir and configured to direct a flow of tractive material to a contact surface of the rail, a compressed air reservoir, and a compressed air nozzle in communication with the compressed air reservoir and configured to direct a flow of compressed air to the contact surface of the rail. The system further includes a control unit electrically coupled to a first rail vehicle in the consist, the control unit having a processor and being configured to receive signals indicative of slippage, individual axle tractive effort, overall rail vehicle tractive effort and horsepower. The control unit is further configured to control the tractive effort system to apply compressed air only to the contact surface of the rail and monitor at least one of slippage, individual axle tractive effort, overall rail vehicle tractive effort and horsepower after application of the compressed air only. The control unit may be configured to control the tractive effort system to apply tractive material to the contact surface of the rail as a backup to the application of compressed air only in dependence upon at least one of rail vehicle speed and rail vehicle tractive effort. The control unit may be configured to control the tractive effort system to apply tractive material to the contact surface of the rail as a backup to the application of compressed air only in dependence upon at least one of elapsed time since tractive effort system activation, distance traversed since tractive effort system activation, geographical location, operator input and measured or inferred tractive material reservoir levels.

Another embodiment of the present invention relates to a method for controlling a rail vehicle or other vehicle having a tractive effort system. The method includes the steps of enabling the tractive effort system to apply a blast of air only to the rail, monitoring one of slip, individual axle tractive effort, overall tractive effort and horsepower, and enabling the tractive effort system to apply tractive material to the rail in dependence upon at least one parameter. The at least one parameter may be a speed of the rail vehicle, a tractive effort of the rail vehicle, a distance traveled since the tractive effort system was enabled, and/or measured or inferred tractive material level.

Another embodiment relates to a method of controlling a rail vehicle or other vehicle. The method comprises providing a supply of pressurized air from a reservoir to a tractive effort system of the rail vehicle, and varying the flow of air to the tractive effort system to maintain a pressure in the reservoir above a predetermined lower threshold.

In another embodiment of the method, varying the flow of air includes selectively controlling a size of an orifice in an air flow path between the reservoir and a nozzle of the tractive effort system in dependence upon an available air pressure in the reservoir. The size of the orifice may be controlled by a continuously variable orifice valve.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. As used herein, the terms "including" and "in which" are used as the plain-English equivalents of the respective terms "comprising" and "wherein." Moreover, the terms "first," "second," "third," "upper," "lower," "bottom," "top," etc. are used merely as labels, and are not intended to impose numerical or positional requirements on their objects. This written description uses examples to disclose several embodiments of the invention, including the best mode, and also to enable one of ordinary skill in the art to practice the embodiments of invention, including making and using any devices or systems and performing any incorporated methods.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described adhesion control system and method, without departing from the spirit and scope of the invention herein involved, it is intended that all of the subject matter of the above description or shown in the accompanying drawings shall be interpreted merely as examples illustrating the inventive concept herein and shall not be construed as limiting the invention.

The invention claimed is:

1. A system comprising:

an air source for supplying compressed air on board a vehicle having a wheel that travels on a route;

a nozzle fluidly coupled to the air source and configured to direct a flow of compressed air from the air source to a contact surface of the route;

a valve positioned intermediate the air source and the nozzle, the valve being controllable between a first state in which the compressed air flows from the air source to the nozzle, and a second, disabled state in which the compressed air is prevented from flowing to the nozzle;

a controller for controlling the valve between the first state and the second, disabled state; and an operator interface electrically coupled to the controller, the operator interface including a momentary disable switch biased to a position that controls the valve to the first state and movable against the bias to control the valve to the second, disabled state;

wherein the operator interface includes a monostable button actuatable to selectively toggle the valve between the first state and the second, disabled state, and wherein the controller is configured to automatically control the valve to the first state after a predetermined period of time has elapsed and to automatically control the valve to the first state after a certain distance has been traversed.

2. The system of claim 1, wherein the vehicle is a rail vehicle, the route includes a rail, and the wheel of the rail vehicle is configured to travel along the rail.

3. The system of claim 2, further comprising a sanding nozzle on board the vehicle and configured to distribute tractive material to a contact surface of the rail, apart from the flow of compressed air.

4. The system of claim 2, wherein the controller is further configured to automatically control the valve to the first state after one of a designated throttle transition has occurred, a designated vehicle speed change has occurred, or a designated tractive effort level has been attained.

5. The system of claim 1, wherein the controller is further configured to automatically control the valve to the first state after one of a designated throttle transition has occurred, a designated vehicle speed change has occurred, or a designated tractive effort level has been attained.

6. A system comprising:

an air source for supplying compressed air on board a vehicle having a wheel that travels on a route;

a nozzle fluidly coupled to the air source and configured to direct a flow of compressed air from the air source to a contact surface of the route;

a valve positioned intermediate the air source and the nozzle, the valve being controllable between a first state in which the compressed air flows from the air source to the nozzle, and a second, disabled state in which the compressed air is prevented from flowing to the nozzle;

a controller for controlling the valve between the first state and the second, disabled state; and an operator interface electrically coupled to the controller, the operator interface including a momentary disable switch biased to a position responsive to which the controller is configured to control the valve to the first state and movable against the bias responsive to which the controller is configured to control the valve to the second, disabled state;

wherein the operator interface includes a monostable button actuatable to selectively toggle the valve between the first state and the second, disabled state; and wherein the controller is configured to automatically control the valve to the first state after a predetermined period of time has elapsed and to automatically control the valve to the first state after a certain distance has been traversed.

7. The system of claim 6, wherein the vehicle is a rail vehicle, the route includes a rail, and the wheel of the rail vehicle is configured to travel along the rail.

8. The system of claim 7, further comprising a sanding nozzle on board the vehicle and configured to distribute tractive material to a contact surface of the rail, apart from the flow of compressed air.

9. The system of claim 7, wherein the controller is further configured to automatically control the valve to the first state after one of a designated throttle transition has occurred, a designated vehicle speed change has occurred, or a designated tractive effort level has been attained.

10. The system of claim 6, wherein the controller is further configured to automatically control the valve to the first state after one of a designated throttle transition has occurred, a designated vehicle speed change has occurred, or a designated tractive effort level has been attained.

11. A system comprising:

an air source for supplying compressed air on board a rail vehicle having a wheel that travels on a rail;

a nozzle fluidly coupled to the air source and configured to direct a flow of compressed air from the air source to a contact surface of the rail;

a valve positioned intermediate the air source and the nozzle, the valve being controllable between a first state in which the compressed air flows from the air source to the nozzle, and a second, disabled state in which the compressed air is prevented from flowing to the nozzle;

a controller for controlling the valve between the first state and the second, disabled state;

an operator interface electrically coupled to the controller, the operator interface including a momentary disable switch biased to a position for controlling the valve to the first state and movable against the bias for controlling the valve to the second, disabled state; and a sanding nozzle on board the rail vehicle and configured to distribute tractive material to a contact surface of the rail, apart from the flow of compressed air;

wherein the operator interface includes a monostable button actuatable to selectively toggle the valve between the first state and the second, disabled state, and wherein the controller is configured to automatically control the valve to the first state after a predetermined period of time has elapsed and to automatically control the valve to the first state after a certain distance has been traversed.

* * * * *